US010768658B2

(12) United States Patent
Asano

(10) Patent No.: US 10,768,658 B2
(45) Date of Patent: Sep. 8, 2020

(54) MULTI-DIRECTIONAL INPUT DEVICE

(71) Applicant: Hosiden Corporation, Yao-shi, Osaka (JP)

(72) Inventor: Mitsuhiro Asano, Yao (JP)

(73) Assignee: HOSIDEN CORPORATION, Yao-Shi (JP)

( * ) Notice: Subject to any disclaimer, the term of this patent is extended or adjusted under 35 U.S.C. 154(b) by 0 days.

(21) Appl. No.: 16/534,222

(22) Filed: Aug. 7, 2019

(65) Prior Publication Data

US 2020/0097037 A1 Mar. 26, 2020

(30) Foreign Application Priority Data

Sep. 25, 2018 (JP) ..... 2018-178357

(51) Int. Cl.
*G05G 9/047* (2006.01)
*H01C 10/16* (2006.01)

(52) U.S. Cl.
CPC ..... *G05G 9/047* (2013.01); *H01C 10/16* (2013.01); *G05G 2009/04711* (2013.01); *G05G 2009/04744* (2013.01); *G05G 2009/04751* (2013.01); *G05G 2009/04777* (2013.01)

(58) Field of Classification Search
None
See application file for complete search history.

(56) References Cited

U.S. PATENT DOCUMENTS 6,150,919 A 11/2000 Shimomura
2002/0056621 A1 5/2002 Nakai
2003/0144752 A1* 7/2003 Furukawa ..... G05G 9/047 700/85
2006/0060455 A1 3/2006 Mimata et al.
2009/0050465 A1* 2/2009 Asada ..... H01H 25/06 200/6 A
2015/0198964 A1* 7/2015 Asano ..... G05G 9/047 74/471 XY

FOREIGN PATENT DOCUMENTS

EP 1626424 A2 2/2006
JP 2000-112552 4/2000

OTHER PUBLICATIONS

European Search Report dated Feb. 26, 2020, 9 pages.

* cited by examiner

*Primary Examiner* — Matthew Yeung

(74) *Attorney, Agent, or Firm* — Rankin, Hill & Clark LLP

(57) ABSTRACT

In a multi-directional input device, an upward convex spherical trapezoidal portion is provided at a lower end of an operation shaft projecting downward of a lower arm, a receiving portion for the upward convex spherical trapezoidal portion is provided in a case, the receiving portion has a receiving surface configured with a spherical surface having a radius of curvature identical to a radius of curvature of a spherical zone of the upward convex spherical trapezoidal portion, the receiving surface against which the spherical zone of the upward convex spherical trapezoidal portion is pressed downward by a compression coil spring, and the operation shaft is supported to be rotatable around the center of curvature of the receiving surface.

4 Claims, 17 Drawing Sheets

MULTI-DIRECTIONAL INPUT DEVICE

BACKGROUND OF THE INVENTION

(1) Field of the Invention

The present invention relates to a multi-directional input device.

(2) Description of Related Art

As shown in JP 2000-112552 A, a conventional multi-directional input device includes a case, a pair of upper and lower arms, an operation shaft, an actuating member, a compression coil spring, and a plurality of electric components. The case has a bottom plate. The pair of upper and lower arms are movably supported in two directions orthogonal to each other in the case, and each has an elongated hole extending in a direction orthogonal to a moving direction. The operation shaft is rotatable in a state of passing through each elongated hole. The actuating member is movably supported in an axial direction of the operation shaft at a lower end of the operation shaft projecting downward of the lower arm, and is provided with a downward convex spherical trapezoidal portion whose diameter decreases downward. The compression coil spring presses the spherical trapezoidal portion of the actuating member against the bottom plate to return the operation shaft to a neutral state. The plurality of electric components are operated through each of the arms by rotation of the operation shaft.

Here, the operation shaft is rotatably supported by the lower arm in a direction where the elongated hole extends, in order to prevent the operation shaft from coming off. In addition, in consideration of assemblability, the operation shaft is rotatably supported by the lower arm in the direction where the elongated hole extends, by snap-engaging a projecting shaft support portion provided on an outer surface of the operation shaft with a recessed engaging portion provided in the elongated hole of the lower arm.

PRIOR ART DOCUMENT

Patent Document

Patent Document 1: JP 2000-112552 A

SUMMARY OF THE INVENTION

However, in the conventional multi-directional input device as described above, since the snap-engaging portion between the operation shaft and the lower arm serves as a rotation center of the operation shaft, it becomes difficult to reduce the entire height of the device when the rotation radius of the operation shaft is increased. Further, in order to ensure the assemblability, it is difficult to provide sufficient strength to the snap-engaging portion between the operation shaft and the lower arm.

The present invention has been made in view of the problems as described above, and an object of the present invention is to provide a multi-directional input device, in which the entire height of the device can be reduced even when the rotation radius of an operation shaft is increased and the device can be downsized without lowering the strength of the operation shaft and a lower arm.

In order to achieve the above object, according to a first aspect of the present invention, there is provided a multi-directional input device, including: a case having a bottom plate; a pair of upper and lower arms supported to be movable in two orthogonal directions in the case, the pair of upper and lower arms each having an elongated hole extending in a direction orthogonal to a moving direction; an operation shaft that is rotatable in a state of penetrating each elongated hole, an actuating member that is supported to be movable in an axial direction of the operation shaft at a lower end of the operation shaft projecting downward of the lower arm, and is provided with a downward convex spherical trapezoidal portion whose diameter decreases downward; a compression coil spring that is provided between the operation shaft and the actuating member, and presses the downward convex spherical trapezoidal portion against the bottom plate to return the operation shaft to a neutral state; and a plurality of electric components operated via each arm by rotation of the operation shaft. An upward convex spherical trapezoidal portion whose diameter decreases upward is provided at a lower end of the operation shaft projecting downward of the lower arm. A receiving portion for the upward convex spherical trapezoidal portion is provided in the case. The receiving portion has a receiving surface that is configured with a spherical surface having a radius of curvature identical to a radius of curvature of a spherical zone of the upward convex spherical trapezoidal portion, the receiving surface against which a spherical zone of the upward convex spherical trapezoidal portion is pressed from downward by the compression coil spring. The operation shaft is supported to be rotatable about a center of curvature of the receiving surface.

Further, according to a second aspect of the present invention, there is provided a multi-directional input device, including: a case having a bottom plate; a pair of upper and lower arms supported to be movable in two orthogonal directions in the inside of the case, the pair of upper and lower arms each having an elongated hole extending in a direction orthogonal to a moving direction; an operation shaft that is rotatable in a state of penetrating each elongated hole; an actuating member that is supported to be movable in an axial direction of the operation shaft at a lower end of the operation shaft projecting downward of the lower arm, and is provided with a downward convex spherical trapezoidal portion whose diameter decreases downward; a compression coil spring that is provided between the operation shaft and the actuating member, and presses the downward convex spherical trapezoidal portion against the bottom plate to return the operation shaft to a neutral state; and a plurality of electric components operated via each arm by rotation of the operation shaft. The actuating member is supported at a lower end of the operation shaft projecting downward of the lower arm in a state of reducing rotation around an axis of the operation shaft and is provided with a protrusion projecting radially outward from an upper end of the downward convex spherical trapezoidal portion. The protrusion is inserted to be movable vertically in a guide groove that extends in a vertical direction on an inner wall of the case, so that rotation around an axis of the operation shaft of the actuating member is reduced.

Further, according to a third aspect of the present invention, there is provided a multi-directional input device, including: a case having a bottom plate; a pair of upper and lower arms supported to be movable in two orthogonal directions in the case, the upper and lower arms each having an elongated hole extending in a direction orthogonal to a moving direction; an operation shaft that is rotatable in a state of penetrating each elongated hole, an actuating member that is supported to be movable in an axial direction of the operation shaft at a lower end of the operation shaft projecting downward of the lower arm, and is provided with a downward convex spherical trapezoidal portion whose diameter decreases downward; a compression coil spring that is provided between the operation shaft and the actuating member, and presses the downward convex spherical trapezoidal portion against the bottom plate to return the operation shaft to a neutral state; and a plurality of electric components operated via each arm by rotation of the operation shaft. An upward convex spherical trapezoidal portion whose diameter decreases upward is provided at a lower end of the operation shaft projecting downward of the lower arm. A receiving portion for the upward convex spherical trapezoidal portion is provided in the case. The receiving portion has a receiving surface that is configured with a spherical surface having a radius of curvature identical to a radius of curvature of a spherical zone of the upward convex spherical trapezoidal portion, the receiving surface against which a spherical zone of the upward convex spherical trapezoidal portion is pressed from downward by the compression coil spring. The operation shaft is supported to be rotatable about a center of curvature of the receiving surface. The lower arm has a curved upper surface provided along a cylindrical surface arranged coaxially on one horizontal axis that passes through the center of curvature of the receiving surface and extends in a moving direction of the lower arm. The operation shaft is provided with an engaging portion with the lower arm. The engaging portion has a downward engaging surface that is curved along the curved upper surface of the lower arm and is movable on the curved upper surface of the lower arm when the operation shaft rotates.

Further, according to a fourth aspect of the present invention, there is provided the multi-directional input device according to the third aspect, further including: a pusher that is supported to be vertically movable in the case; and a pressing switch that detects pressing movement of the operation shaft. The pusher is moved by the lower arm that is moved downward with pressing movement of the operation shaft. The pressing switch is operated via the pusher.

According to the present invention, an upward convex spherical trapezoidal portion whose diameter decreases upward is provided at the lower end of the operation shaft projecting downward of the lower arm, and the receiving portion for the upward convex spherical trapezoidal portion is provided in the case. The receiving portion has a receiving surface that is configured with a spherical surface having the same radius of curvature as the radius of curvature of the spherical zone of the upwardly convex spherical trapezoidal portion, the receiving surface against which a spherical zone of the upward convex spherical trapezoidal portion is pressed from downward by the compression coil spring. The operation shaft is supported to be rotatable about the curvature center of the receiving surface. In this manner, since the operation shaft is supported to be rotatable about the curvature center of the receiving surface of the receiving portion while being prevented from coming off by the receiving portion positioned downward of the lower arm, the entire height of the device is reduced even if the rotation radius of the operation shaft is increased, and the device can be downsized without lowering the strength of the operation shaft and the lower arm.

Further, the actuating member is supported by the lower end of the operation shaft in a state in which the rotation around an axis of the operation shaft is regulated, and is provided with a protrusion projecting radially outward from an upper end of the downward convex spherical trapezoidal portion. The protrusion is inserted so as to be movable vertically in a guide groove that extends in a vertical direction on an inner wall of the case, so that rotation around an axis of the operation shaft of the actuating member is regulated. In this manner, rotation around an axis of the operation shaft is regulated via the actuating member. Therefore, degree of freedom in a shape of the lower arm is increased, the lower arm can be downsized, and the device can be downsized.

Further, an upward convex spherical trapezoidal portion whose diameter decreases upward is provided at the lower end portion of the operation shaft projecting downward of the lower arm, and a receiving portion for the upward convex spherical trapezoidal portion is provided in the case. The receiving portion has a receiving surface that is configured with a spherical surface having the same radius of curvature as radius of curvature of a spherical zone of the upward convex spherical trapezoidal portion, the receiving surface against which a spherical zone of the upward convex spherical trapezoidal portion is pressed from downward by the compression coil spring. The operation shaft is supported so as to be rotatable about the center of curvature of the receiving surface. The lower arm has a curved upper surface provided along a cylindrical surface arranged coaxially on one horizontal axis that passes through the center of curvature of the receiving surface and extends in a moving direction of the lower arm. The operation shaft is provided with an engaging portion with the lower arm. The engaging portion has a downward engaging surface that is curved along the curved upper surface of the lower arm and is movable on the curved upper surface of the lower arm when the operation shaft rotates. In this manner, the operation shaft in a state of being inserted through an elongated hole of the lower arm from downward is rotated by 90° so that a downward engaging surface of the engaging portion of the operation shaft is arranged to face the curved upper surface of the lower arm for assembly. Accordingly, the operation shaft and the lower arm can be provided with enough strength, and the device can be downsized without lowering of the strength of the operation shaft and the lower arm.

Further, the pusher supported movably in the vertical direction and the pressing switch for detecting the pressing movement of the operation shaft are further included in the case, the lower arm moving downward with the pressing movement of the operation shaft moves downward the pusher, and the pressing switch is operated via the pusher. In this manner, before the pusher is incorporated, the lower arm has degree of freedom in a downward direction, and there is no possibility of interference between the downward engaging surfaces of the engaging portions of the operation shaft and the curved upper surface of the lower arm even if the operation shaft is rotated by 90° and assembled. For this reason, a gap (clearance) between the downward engaging surface of the engaging portion of the operation shaft and the curved upper surface of the lower arm can sufficiently be reduced, and the pressing switch can be operated with a short stroke.

DETAILED DESCRIPTION OF PREFERRED EMBODIMENTS

Figure 1:
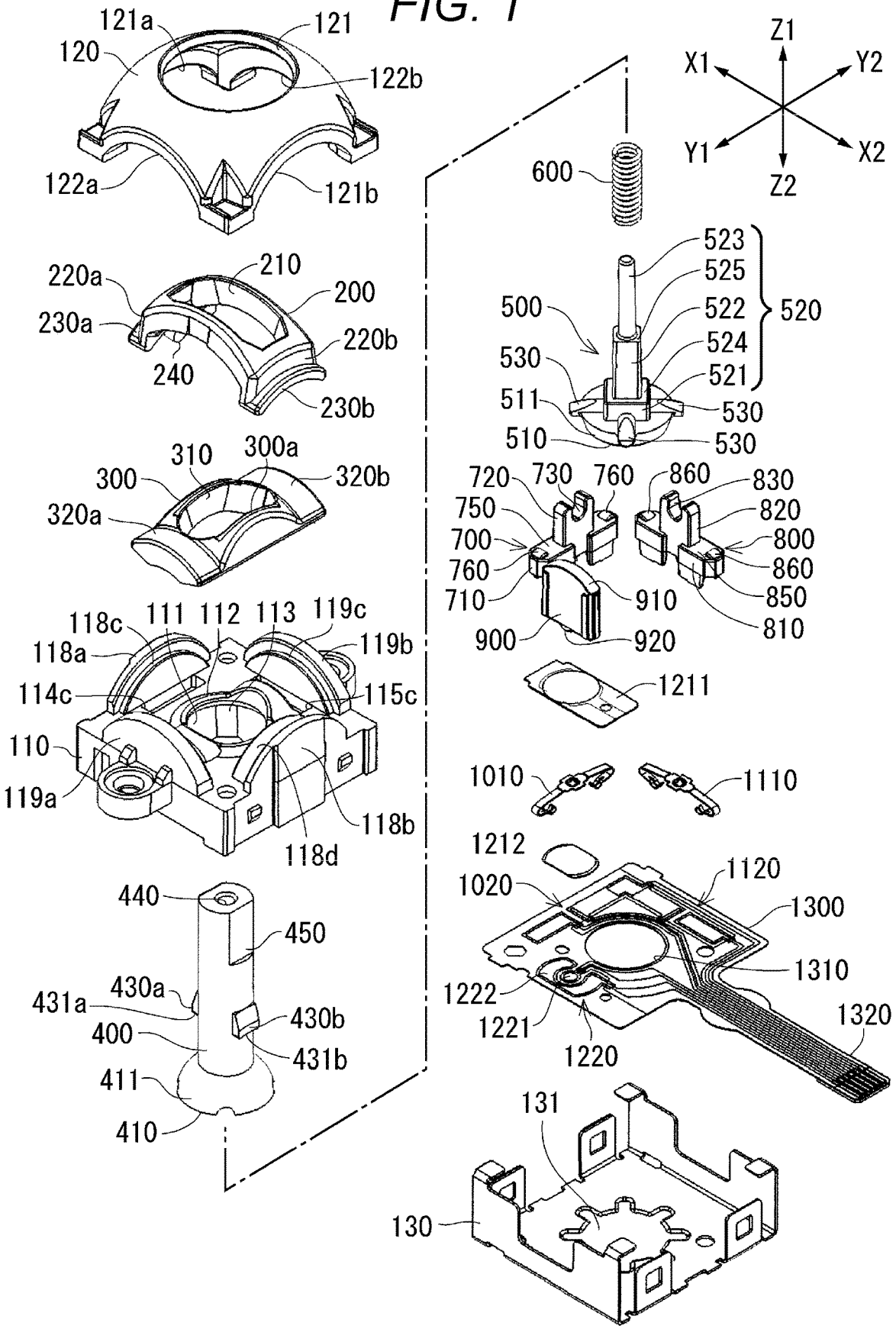
FIG. 1 is an exploded perspective view of a multi-directional input device according to an embodiment of the present invention.
Figure 2:
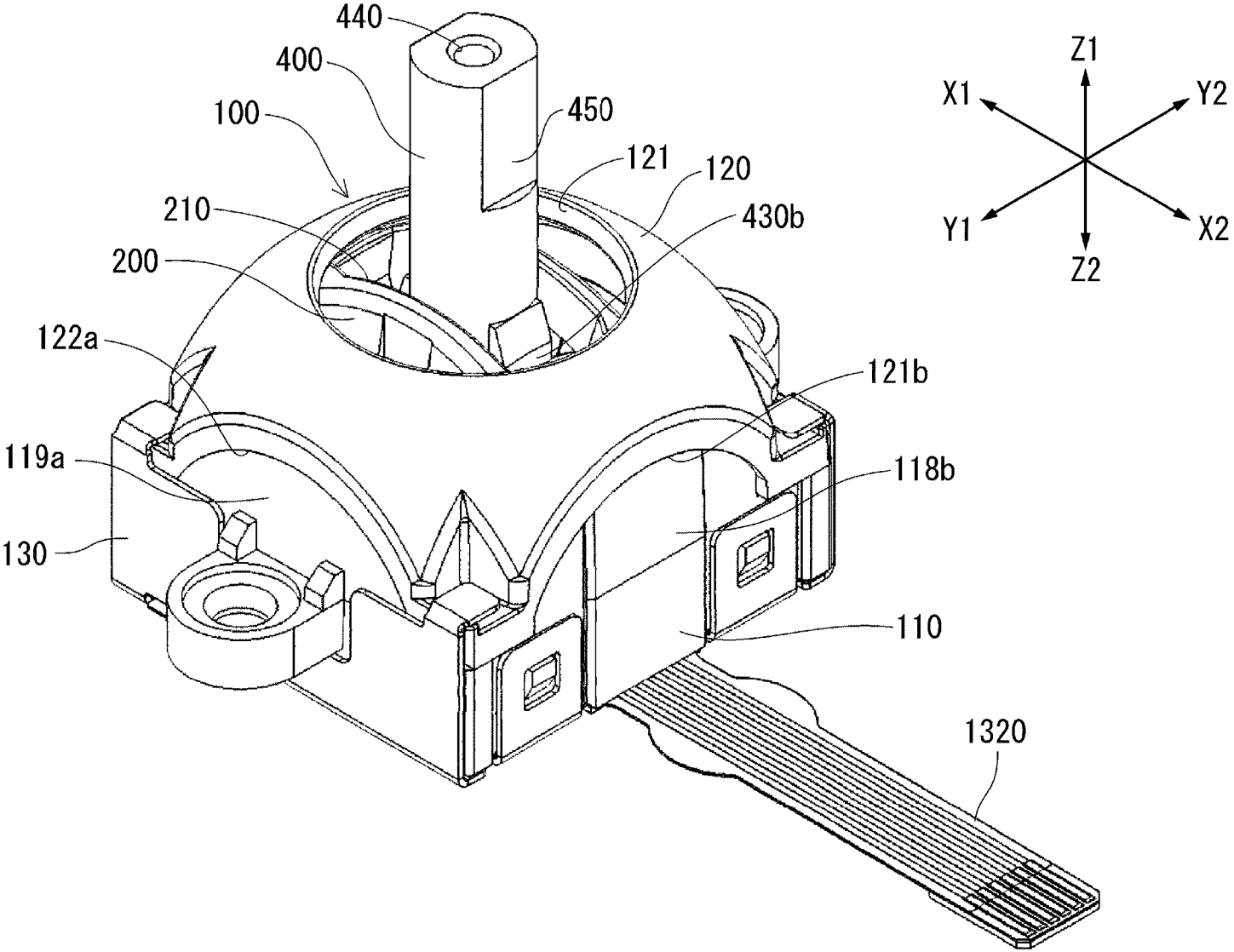
FIG. 2 is a perspective view of the multi-directional input device according to the embodiment of the present invention.
Figure 3:
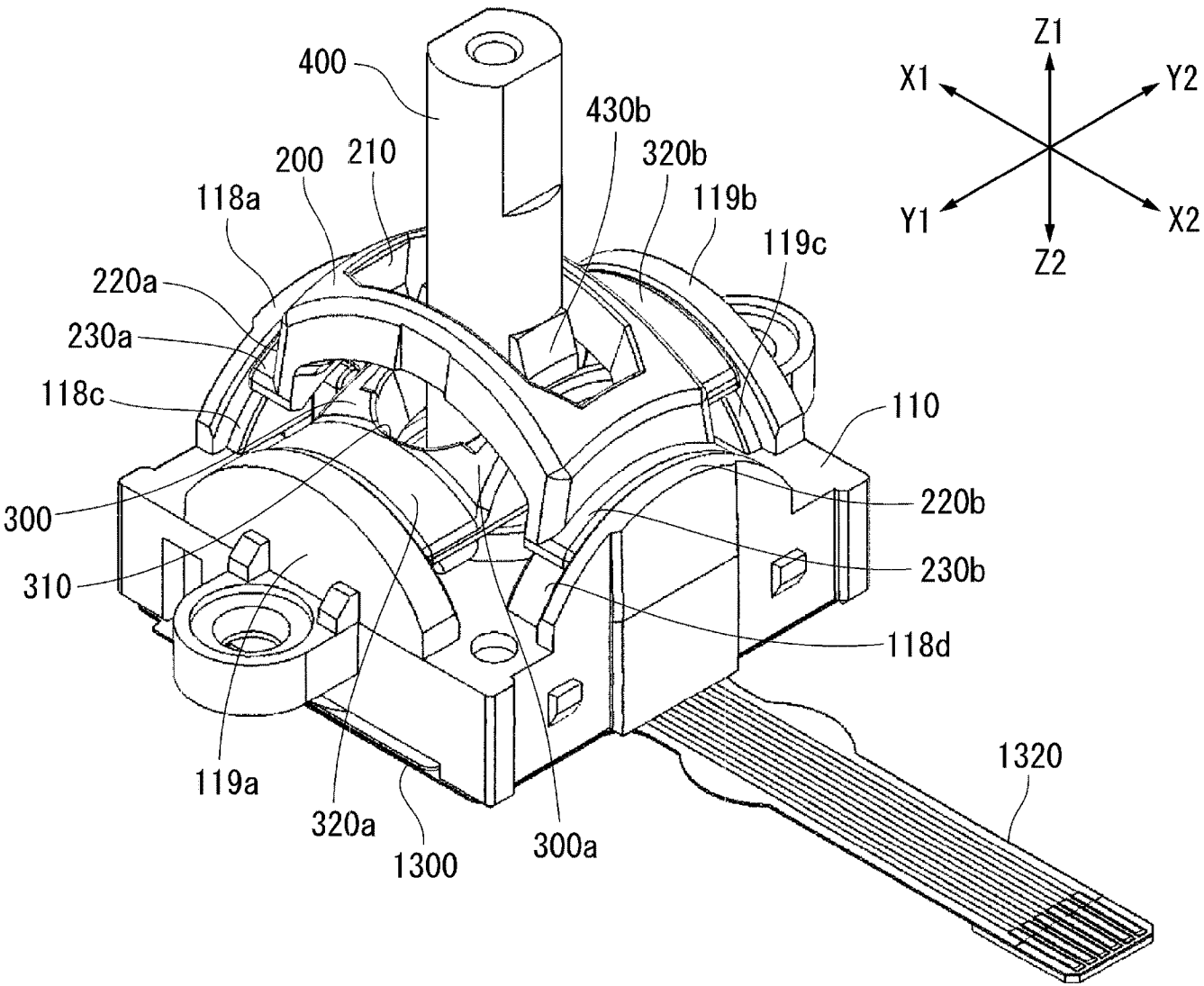
FIG. 3 is a perspective view of a state in which a frame and a cover of FIG. 2 are transparent.

Hereinafter, a multi-directional input device according to an embodiment of the present invention will be described based on the drawings.

As shown in FIGS. 1 to 17, the multi-directional input device according to the embodiment of the present invention includes a case 100, a pair of upper and lower arms 200 and 300, an operation shaft 400, an actuating member 500, a compression coil spring 600, first and second sliders 700 and 800, a pusher 900, first and second variable resistors 1000 and 1100 which are first and second electric components, a pressing switch 1200 which is a third electric component, and a substrate 1300.

In coordinate axes shown in FIGS. 1 to 17, a Y1-Y2 direction is a front-rear direction (depth direction) of the multi-directional input device, an X1-X2 direction is a lateral direction (width direction) of the multi-directional input device, and a Z1-Z2 direction is a vertical direction (height direction) of the multi-directional input device. The Y1-Y2 direction intersects the X1-X2 direction at right angles, and the Z1-Z2 direction intersects the Y1-Y2 direction and the X1-X2 direction at right angles. The Y1-Y2 direction and the X1-X2 direction correspond to the "two orthogonal directions" in the claims. The Z1-Z2 direction corresponds to the "vertical direction" in the claims.

As shown in FIG. 1, FIG. 2, and FIG. 7 to FIG. 13, the case 100 is provided with a cuboid shaped body 110 made of insulating synthetic resin, a cover 120 that is made of insulating synthetic resin, has a dome-like shape which is convex upward and a diameter decreasing upward, is provided with a circular opening 121 for inserting the operation shaft 400 at the top, and is placed on a top surface of the body 110, and a frame 130 that is made of sheet metal and has a rectangular bottom plate 131 covering a lower surface of the body 110. The cover 120 and the frame 130 are positioned and connected to and assembled with the body 110.

As shown in FIGS. 1 to 4, 8 to 13, and 15, the body 110 has an operation shaft accommodation portion 111 for rotatably accommodating a lower end of the operation shaft 400, a receiving portion 112 for rotatably supporting the lower end of the operation shaft 400 while also serving to prevent the operation shaft 400 from coming off, a guide groove 113 for regulating rotation of the operation shaft 400 about the axis via the actuating member 500, a first slider accommodation portion 114 for accommodating the first slider 700 movably in the front-rear direction, a second slider accommodation portion 115 for accommodating the second slider 800 movably in the lateral direction, a pressing switch accommodation portion 116 for accommodating the pressing switch 1200, a pusher accommodation portion 117 for movably accommodating the pusher 900 in the vertical direction, a pair of left and right guide plates 118*a* and 118*b* for moving the upper arm 200 in an arc shape in the front-rear direction, and a pair of front and rear guide plates 119*a* and 119*b* for moving the lower arm 300 in an arc shape in the lateral direction.

As shown in FIGS. 8 to 10 and 15, the operation shaft accommodation portion 111 is a cylindrical hole penetrating a central portion of the body 110 in the vertical direction.

Figure 8:
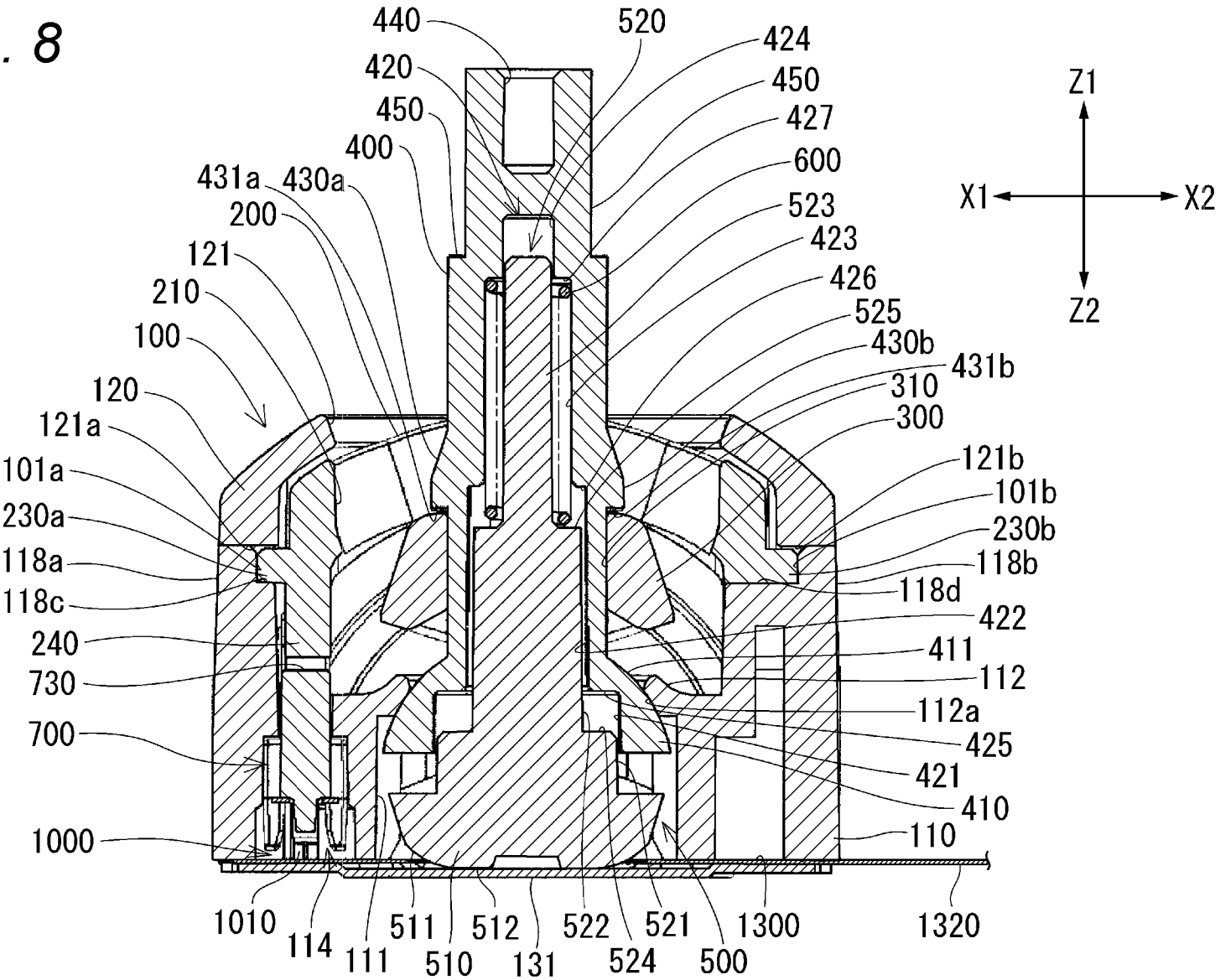
FIG. 8 is a cross-sectional view taken along line A-A of FIG. 7.
Figure 9:
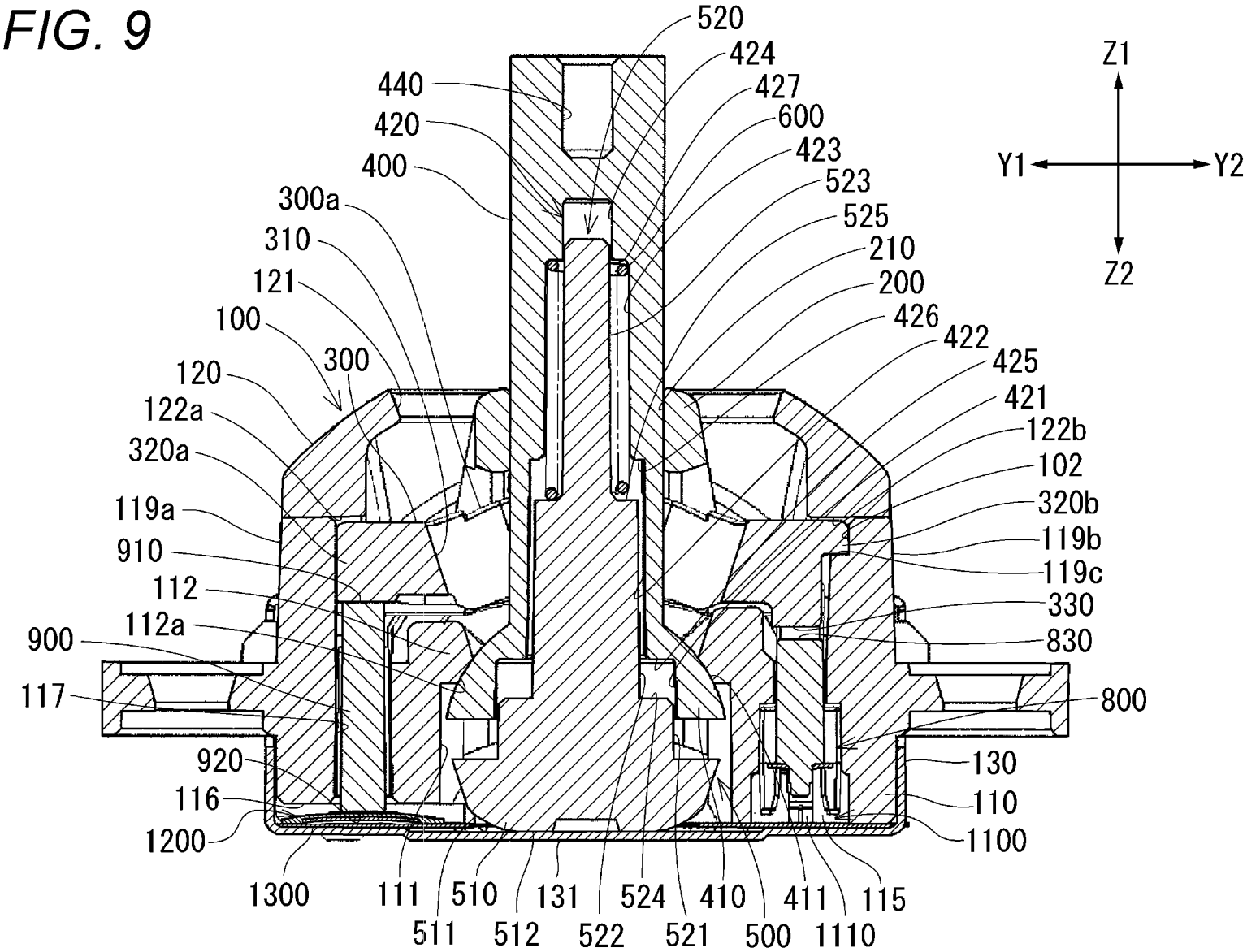
FIG. 9 is a cross-sectional view taken along line B-B in FIG. 7.
Figure 10:
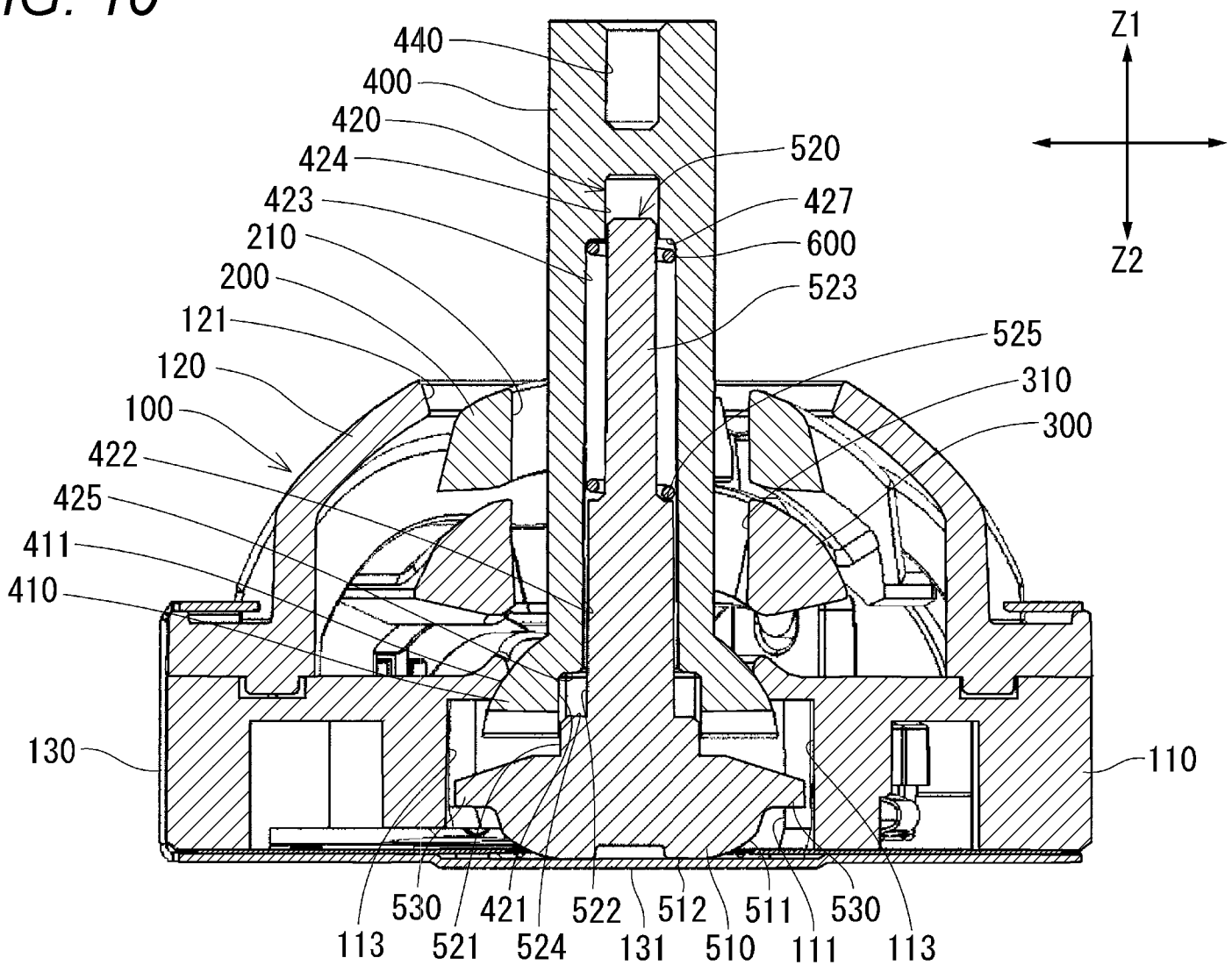
FIG. 10 is a cross-sectional view taken along line C-C of FIG. 7.

As shown in FIGS. 8 to 10, the receiving portion 112 is a receiving portion of an upward convex spherical trapezoidal portion 410 provided at a lower end of the operation shaft 400 projecting downward of the lower arm 300 and having a diameter decreasing upward. The receiving portion 112 is formed into an upward concave spherical shape whose diameter decreases upward in a state of being projecting inward from an upper end opening edge of the operation shaft accommodation portion 111. The receiving portion 112 has a receiving surface 112*a*, which is a receiving portion configured with a surface of a spherical zone shape having the radius of curvature same as the radius of curvature of a spherical zone 411 of a side surface portion of the upward convex spherical trapezoidal portion 410, and against which the spherical zone 411 of the upward convex spherical trapezoidal portion 410 is pressed downward by the compression coil spring 600. The receiving portion 112 supports the operation shaft 400 so as to be rotatable around the center of curvature of the receiving surface 112*a*, while also serving to prevent the operation shaft 400 from coming off.

Figure 15:
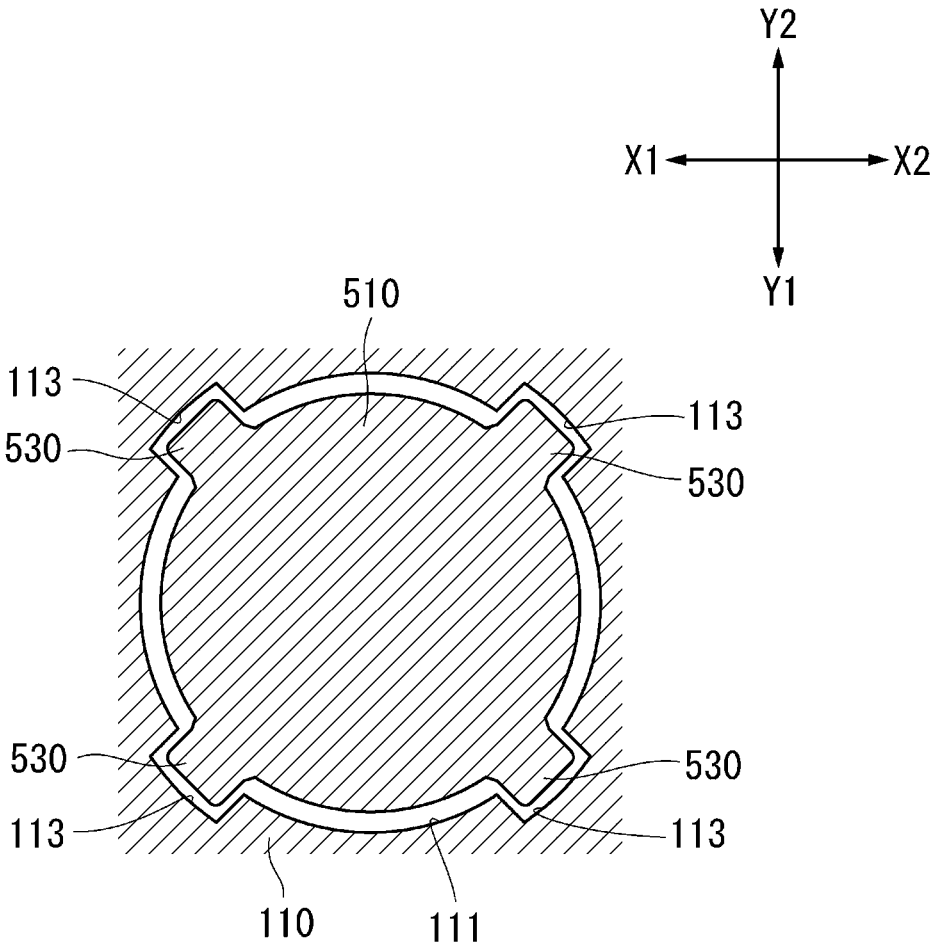
FIG. 15 is a cross-sectional plan view of an operation shaft accommodation hole of the body.

As shown in FIGS. 10 and 15, the guide groove 113 is a groove having a U-shaped cross section, which is provided on a peripheral wall of the operation shaft accommodation portion 111 to extend in the vertical direction. A plurality of the guide grooves 113 are provided at equal intervals in a circumferential direction on the peripheral wall of the operation shaft accommodation portion 111. One of the guide grooves 113 is provided in each of four directions which are diagonal directions of the body 110.

Figure 11:
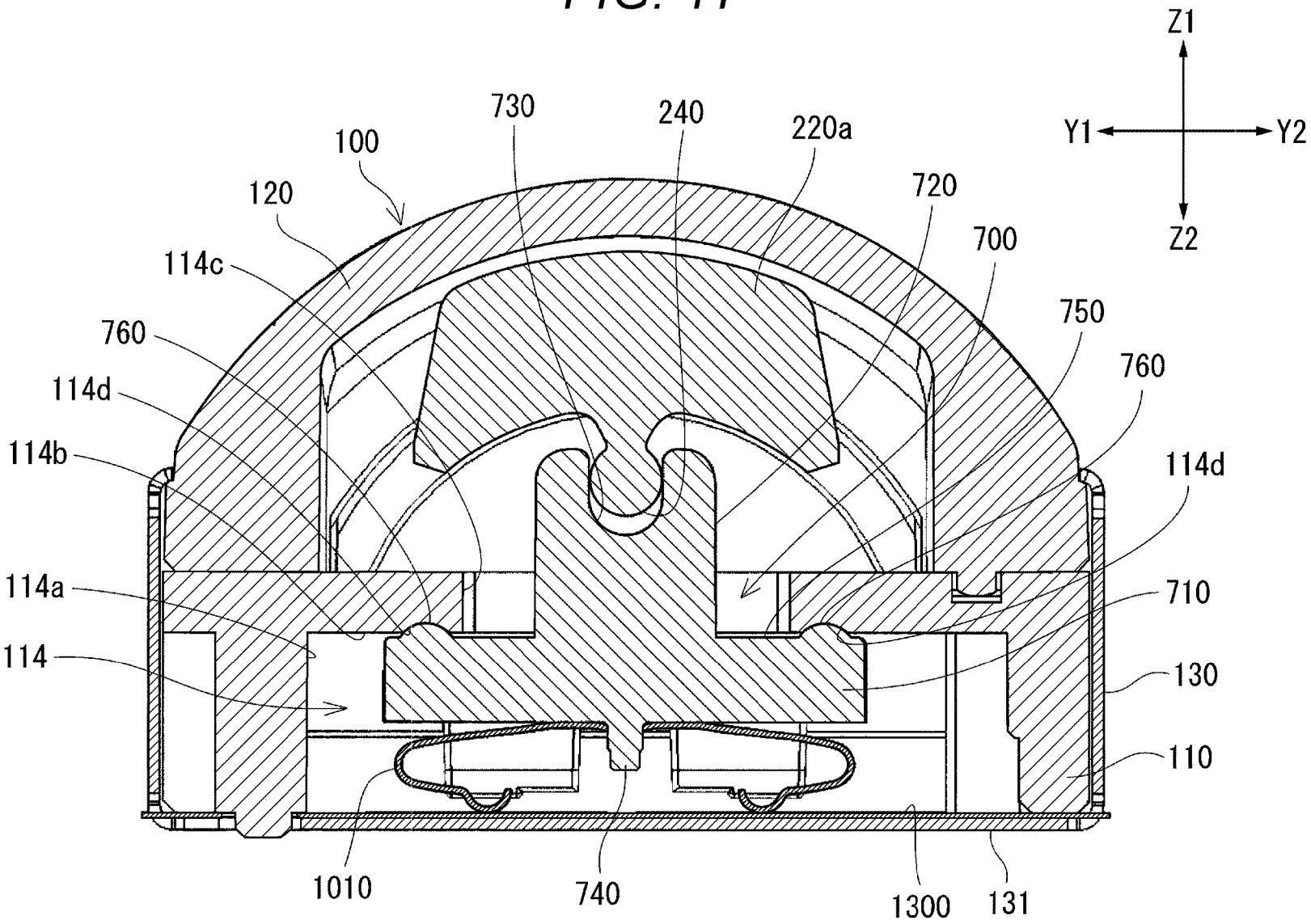
FIG. 11 is a cross-sectional view taken along line D-D of FIG. 7.

As shown in FIGS. 8 and 11, the first slider accommodation portion 114 is provided between the operation shaft accommodation portion 111 of the body 110 and a left side surface of the body 110, and has a first lower movement path 114*a*, a first fixing surface 114*b*, a first upper movement path 114*c*, and a first concave portion 114*d*. The first lower movement path 114*a* is provided on a lower surface of the body 110 between the operation shaft accommodation portion 111 of the body 110 and the left side surface of the body 110. The first lower movement path 114*a* is a rectangular bottomed hole whose longitudinal direction is the front-rear direction, and a rectangular flat bottom surface of the hole, that is, a flat top surface of the first lower movement path 114*a* is the first fixing surface 114*b*. The first upper movement path 114*c* is provided at the center of the first fixing surface 114*b*. The first upper movement path 114*c* is a rectangular hole whose longitudinal direction is the front-rear direction, and penetrates an upper surface of the body 110 to connect the first lower movement path 114*a* and the inside of the cover 120.

The first concave portion 114*d* is a fitting portion to be fitted with a first convex portion 760 provided on the first slider 700 when the first slider 700 is at a neutral position, and is provided on each of the first fixing surface 114*b* located closer to a front side relative to the first upper movement path 114*c* and the first fixing surface 114*b* located closer to a rear side relative to the first upper movement path 114*c*. A fitting shape of the first concave portion 114*d* with the first convex portion 760 is a cylindrical surface formed in a cylindrical surface extending in the lateral direction orthogonal to a moving direction (front-rear direction) of the first slider 700, and has an upward convex arc-like cross-sectional shape.

Figure 12:
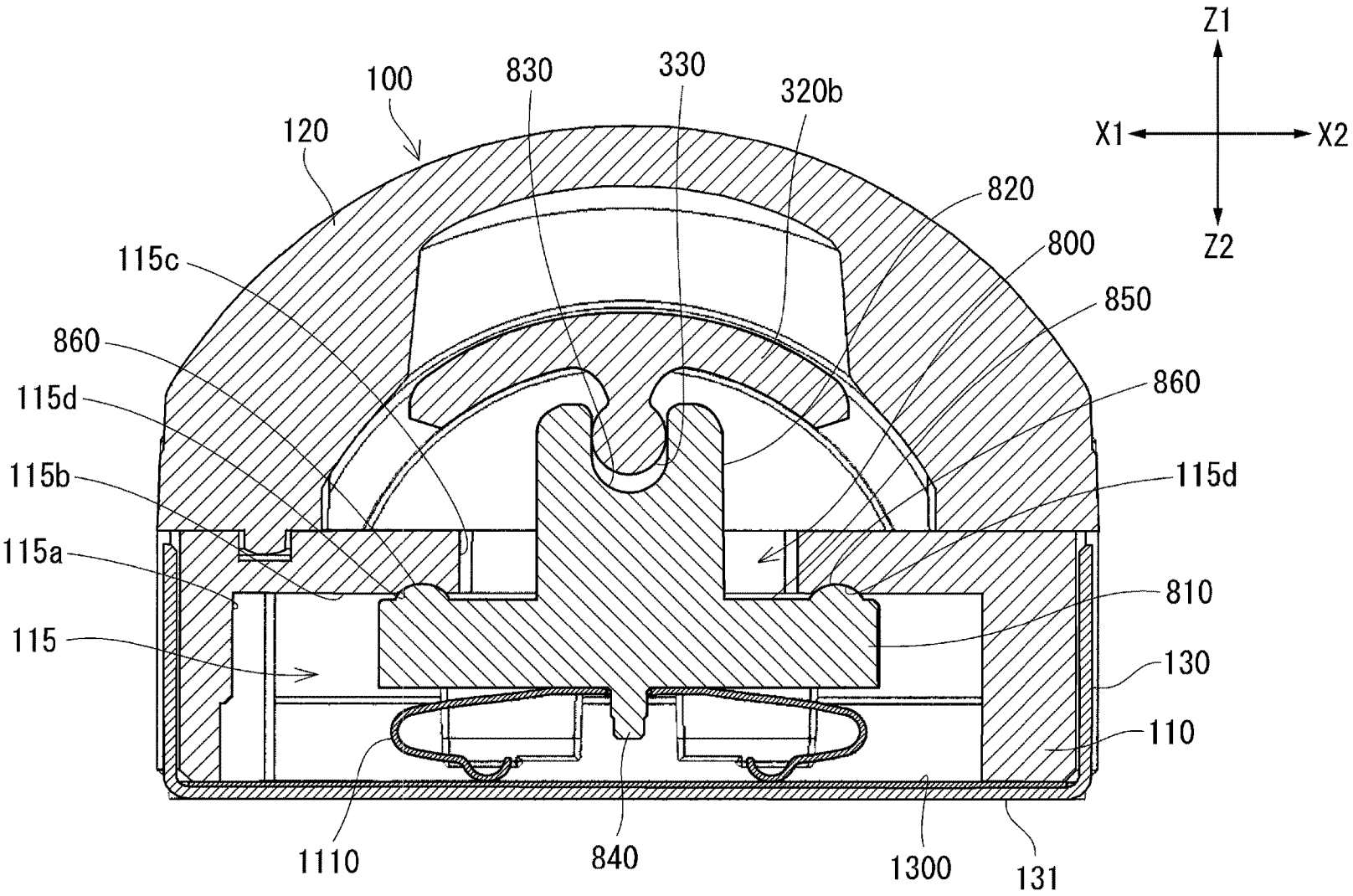
FIG. 12 is a cross-sectional view taken along line E-E of FIG. 7.

As shown in FIGS. 9 and 12, the second slider accommodation portion 115 is provided between the operation shaft accommodation portion 111 of the body 110 and a rear side surface of the body 110, and has a second lower movement path 115*a*, a second fixing surface 115*b*, a second upper movement path 115*c*, and a second concave portion 115*d*. The second lower movement path 115*a* is provided on a lower surface of the body 110 between the operation shaft accommodation portion 111 of the body 110 and the rear side surface of the body 110. The second lower movement path 115*a* is a rectangular bottomed hole whose longitudinal direction is the lateral direction, and a rectangular flat bottom surface of the hole, that is, a flat top surface of the second lower movement path 115*a* is the second fixing surface 115*b*. The second upper movement path 115*c* is provided at the center of the second fixing surface 115*b*. The second upper movement path 115*c* is a rectangular hole whose longitudinal direction is the lateral direction, and penetrates the upper surface of the body 110 to connect the second lower movement path 115*a* and the inside of the cover 120.

The second concave portion 115*d* is a fitting portion to be fitted with a second convex portion 860 provided on the second slider 800 when the second slider 800 is at a neutral position, and is provided on each of the first fixing surface 114*b* located closer to a left side relative to the second upper movement path 115*c* and the second fixing surface 115*b* located closer to a right side relative to the second upper movement path 115*c*. A fitting shape of the second concave portion 115*d* with the second convex portion 860 is a cylindrical surface formed in a cylindrical surface extending in the front-rear direction orthogonal to a moving direction (lateral direction) of the second slider 800, and has an upward convex arc-like cross-sectional shape.

Figure 13:
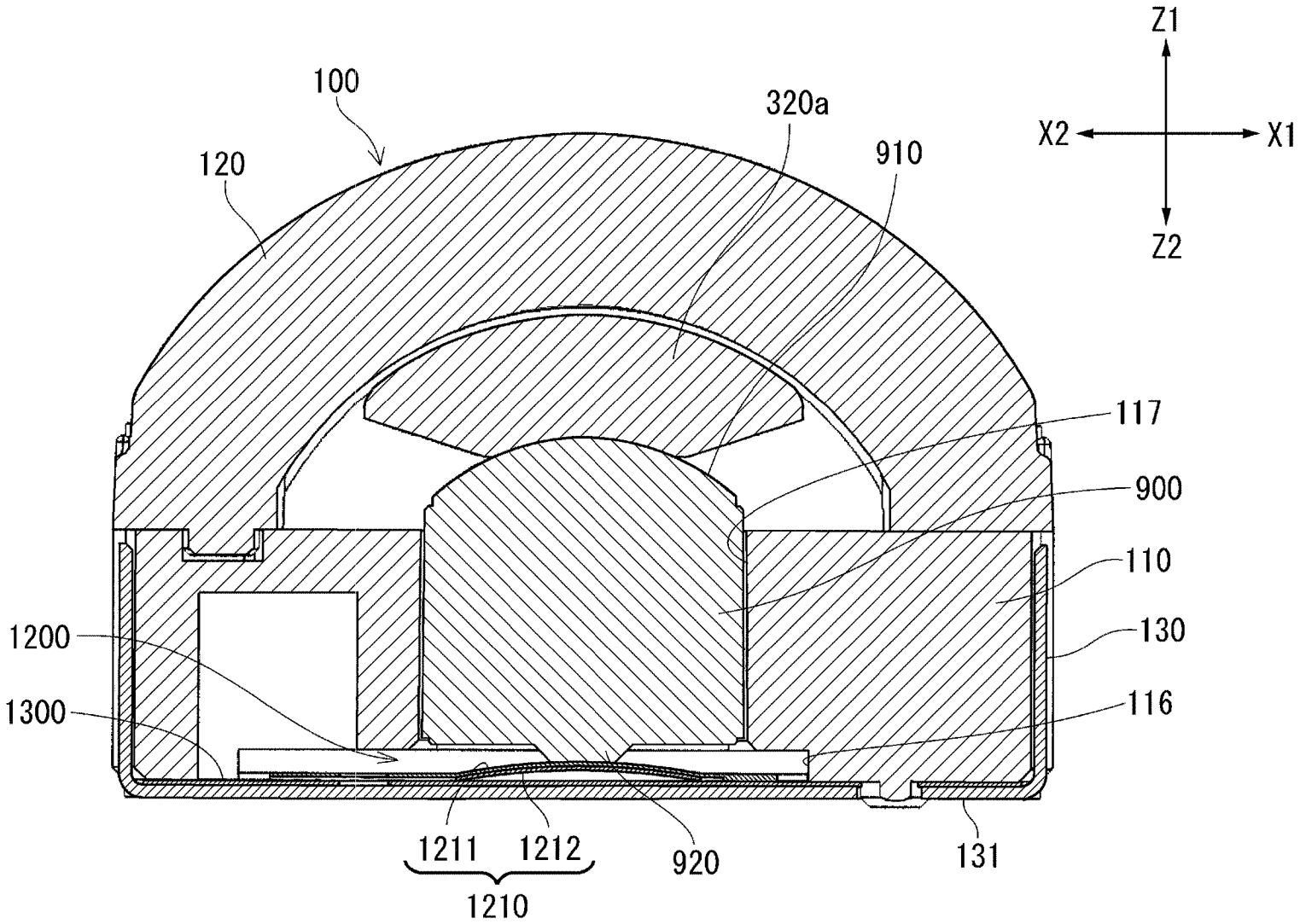
FIG. 13 is a cross-sectional view taken along line F-F of FIG. 7.

As shown in FIGS. 9 and 13, the pressing switch accommodation portion 116 is provided on the lower surface of the body 110 between the operation shaft accommodation portion 111 of the body 110 and the front side surface of the body 110. The pressing switch accommodation portion 116 is a rectangular bottomed shallow hole whose longitudinal direction is the lateral direction.

As shown in FIGS. 9 and 13, the pusher accommodation portion 117 is provided between the operation shaft accommodation portion 111 of the body 110 and the front side surface of the body 110. The pusher accommodation portion 117 is provided on a rectangular bottom surface of the hole which is the pressing switch accommodation portion 116, that is, on a top surface of the pressing switch accommodation portion 116. The pusher accommodation portion 117 is a rectangular hole whose longitudinal direction is the lateral direction and penetrates the upper surface of the body 110 to connect the pressing switch accommodation portion 116 and the inside of the cover 120.

Figure 4:
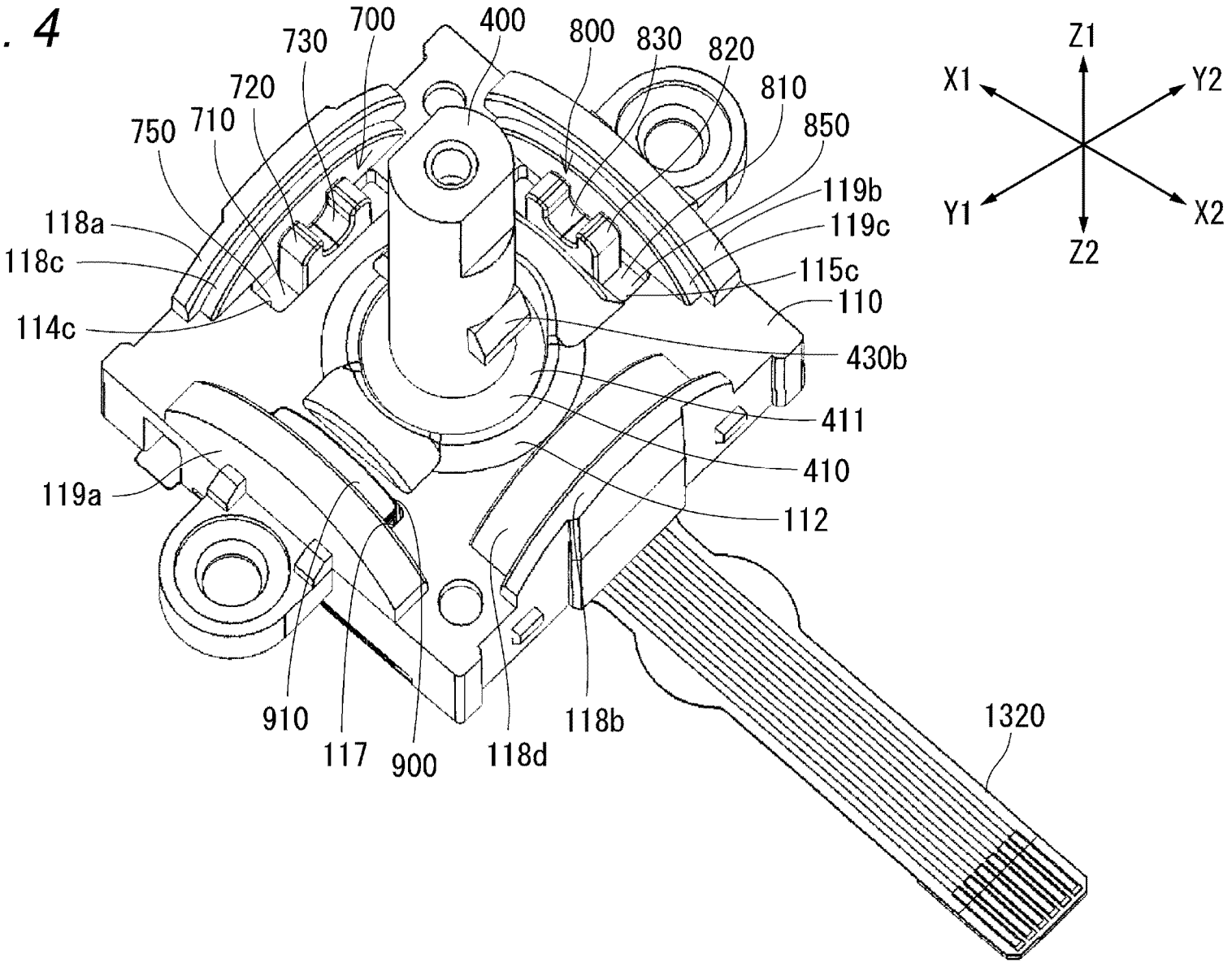
FIG. 4 is a perspective view of a state in which an upper arm and a lower arm in FIG. 3 are transparent.
Figure 5:
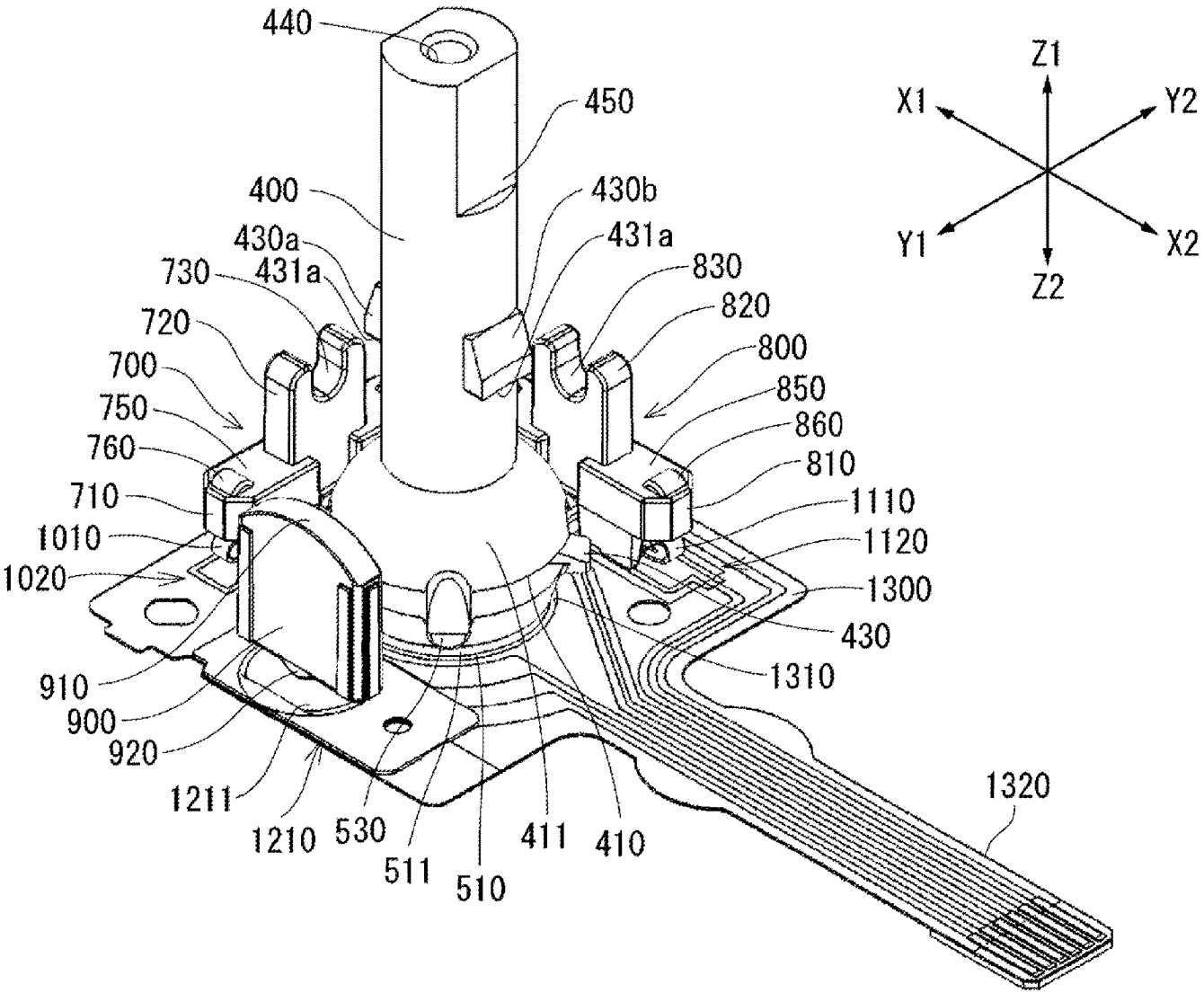
FIG. 5 is a perspective view of a state in which a body of FIG. 4 is transparent.

As shown in FIGS. 4 and 8, the left and right guide plates 118*a* and 118*b* are upward convex, bow-shaped plates which are raised from both left and right ends of the upper surface of the body 110 and opposed in the lateral direction. Arc-shaped left and right arm hooks 118*c* and 118*d*, which are arc-shaped step surfaces one step lower, are provided inside arc-shaped upper end surfaces of the left and right guide plates 118*a* and 118*b*. The arc-shaped upper end surfaces of the left and right guide plates 118*a* and 118*b* and the arc-shaped left and right arm hooks 118*c* and 118*d* are provided along a cylindrical surface coaxially arranged on one horizontal axis (hereinafter referred to as "X axis") that passes through the center of curvature of the receiving surface 112*a* and extends in the lateral direction. On the upper surface of the body 110, the first upper movement path 114*c* is opened along an inner surface of the left guide plate 118*a*.

As shown in FIGS. 4 and 9, the front and rear guide plates 119*a* and 119*b* are upward convex, bow-shaped plates which are raised from both front and rear ends of the upper surface of the body 110 and opposed in the front-rear direction. An arc-shaped rear arm hook 119*c*, which is an arc-shaped step surface lower by one step, is provided only inside the arc-shaped upper end of the rear guide plate 119*b* between the arc-shaped upper ends of the front and rear guide plates 119*a* and 119*b*. The arc-shaped upper ends of the front and rear guide plates 119*a* and 119*b* and the arc-shaped rear arm hook 119*c* of the rear guide plate 119*b* are provided along a cylindrical surface coaxially arranged on one horizontal axis (hereinafter referred to as "Y axis") that passes through the center of curvature of the receiving surface 112*a* and extends in the front-rear direction. On the upper surface of the body 110, the second upper movement path 115*c* is opened along an inner surface of the rear guide plate 119*b*, and the pusher accommodation portion 117 is opened along an inner surface of the front guide plate 119*a*.

The cover 120 is provided with a pair of left and right guide holes 121*a* and 121*b* for moving the upper arm 200 in an arc shape in the front and rear direction, and a pair of front and rear guide holes 122*a* and 122*b* for moving the lower arm 300 in an arc shape in the lateral direction.

As shown in FIGS. 1 and 8, the left and right guide holes 121*a* and 121*b* are upward convex, bow-shaped notches which are opposed in the lateral direction in which the left and right guide plates 118*a* and 118*b* are fitted when the cover 120 is placed on the upper surface of the body 110. In the case 100, a pair of left and right arc-shaped guide grooves 101*a* and 101*b* for moving the upper arm 200 in an arc shape in the front-rear direction are formed between end surfaces of the left and right guide plates 118*a* and 118*b* and end surfaces of the left and right guide holes 121*a* and 121*b* with the left and right arm hooks 118*c* and 118*d* interposed between them. The left and right guide grooves 101*a* and 101*b* have a U-shaped cross-sectional shape and are opened in the case 100. The left and right guide grooves 101*a* and 101*b* are provided along a cylindrical surface coaxially arranged on the X axis.

As shown in FIGS. 1 and 9, the front and rear guide holes 122*a* and 122*b* are upward convex, bow-shaped notches which are opposed in the front-rear direction in which the front and rear guide plates 119*a* and 119*b* are fitted when the cover 120 is placed on the upper surface of the body 110. In the case 100, an arc-shaped rear guide groove 102 for moving the lower arm 300 in an arc shape in the lateral direction is formed between an end surface of the rear guide plates 119*b* and an end surface of the rear guide holes 122*b* with the rear arm hook 119*c* interposed between them. The rear guide groove 102 has a U-shaped cross-sectional shape and is opened in the case 100. The rear guide groove 102 is provided along a cylindrical surface coaxially arranged on the Y-axis.

In the inside of the case 100 configured as described above, a pair of the upper and lower arms 200 and 300, a lower portion of the operation shaft 400, the actuating member 500, the compression coil spring 600, the first and second sliders 700 and 800, the pusher 900, the first and second variable resistors 1000 and 1100, the pressing switch 1200, and the substrate 1300 are accommodated. At the same time, an upper portion of the operation shaft 400 projects from the inside of the case 100 to the outside of the case 100 through the opening 121 of the cover 120.

As shown in FIGS. 1, 5, 6, and 8 to 13, the substrate 1300 is a rectangular flexible printed circuit (FPC), sandwiched between the lower surface of the body 110 and the bottom plate 131, and is arranged in a state of being positioned with respect to the body 110. A circular opening 1310 for exposing the central portion of the bottom plate 131 to the operation shaft accommodation portion 111 is provided at the central portion of the substrate 1300. The substrate 1300 is provided with a tail portion 1320 for external connection. The tail portion 1320 extends in a band shape from the central portion of a left edge of the substrate 1300 to the left and is pulled out to the left of the case 100.

As shown in FIGS. 1, 3, 8 to 10, and 11, the upper arm 200 has an upward convex arch shape (an arc-like shape as viewed from the front-rear direction) made of insulating synthetic resin. The upper arm 200 has an elongated hole 210, a pair of left and right legs 220*a* and 220*b*, a pair of left and right slide parts 230*a* and 230*b*, and an engagement protrusion 240.

The elongated hole 210 has a width as wide as a diameter of the operation shaft 400 and is provided in a longitudinal direction (lateral direction) of an arched portion of the upper arm 200. The arched portion of the upper arm 200 is provided along a cylindrical surface coaxially arranged on the Y-axis. The left and right legs 220*a* and 220*b* are portions extending downward from both left and right ends of the arched portion of the upper arm 200. The left and right slide parts 230*a* and 230*b* protrude outward from lower ends of the left and right legs 220*a* and 220*b* to the left and right, and are arc-shaped protruding parts when viewed from the lateral direction. The left and right slide parts 230*a* and 230*b* are provided along a cylindrical surface coaxially arranged on the X axis. As shown in FIG. 11, the engagement protrusion 240 is a protrusion having an Ω shape in cross section projecting downward from a central portion in the front-rear direction on a lower surface of the left leg 220*a*.

The upper arm 200 is bridged in the lateral direction at the top of the case 100 by slidably fitting the left and right slide parts 230*a* and 230*b* to the left and right guide grooves 101*a* and 101*b*, and in this state, is supported movably in an arc shape in the front-rear direction along the left and right guide grooves 101*a* and 101*b*. The upper arm 200 moves along a cylindrical surface coaxially arranged on the X-axis.

As shown in FIGS. 1, 3, 8 to 10, and FIGS. 12 to 14, the lower arm 300 has an upward convex bow shape (a bow shape as viewed from the lateral direction) made of insulating synthetic resin. The lower arm 300 has an elongated hole 310, a pair of front and rear slide parts 320*a* and 320*b*, and an engagement protrusion 330.

The elongated hole 310 has a width as wide as a diameter of the operation shaft 400 and is provided in a longitudinal direction (front-rear direction) of a bow-shaped portion of the lower arm 300. An upper surface of the bow-shaped portion of the lower arm 300 is provided along a cylindrical surface coaxially arranged on the X-axis. The lower arm 300 has a curved upper surface 300*a* that is formed of the upper surface of the bow-shaped portion, and is provided along a cylindrical surface coaxially arranged on one horizontal axis that passes through the center of curvature of the receiving surface 112*a* and extends in a moving direction (lateral direction) of the lower arm 300, that is, the X axis. The front and rear slide parts 320*a* and 320*b* project from both front and rear ends of the bow-shaped part of the lower arm 300 to outer sides in the front-rear direction, and are arc-shaped projecting parts as viewed from the front-rear direction. The front and rear slide parts 320*a* and 320*b* are provided along a cylindrical surface coaxially arranged on the Y axis. The front slide part 320*a* is formed thicker than the rear slide part 320*b*. As shown in FIG. 12, the engagement protrusion 330 is a protrusion having an Ω shape in cross section projecting downward from a central portion in the lateral direction on a lower surface of the rear slide part 320*b*.

Figure 14:
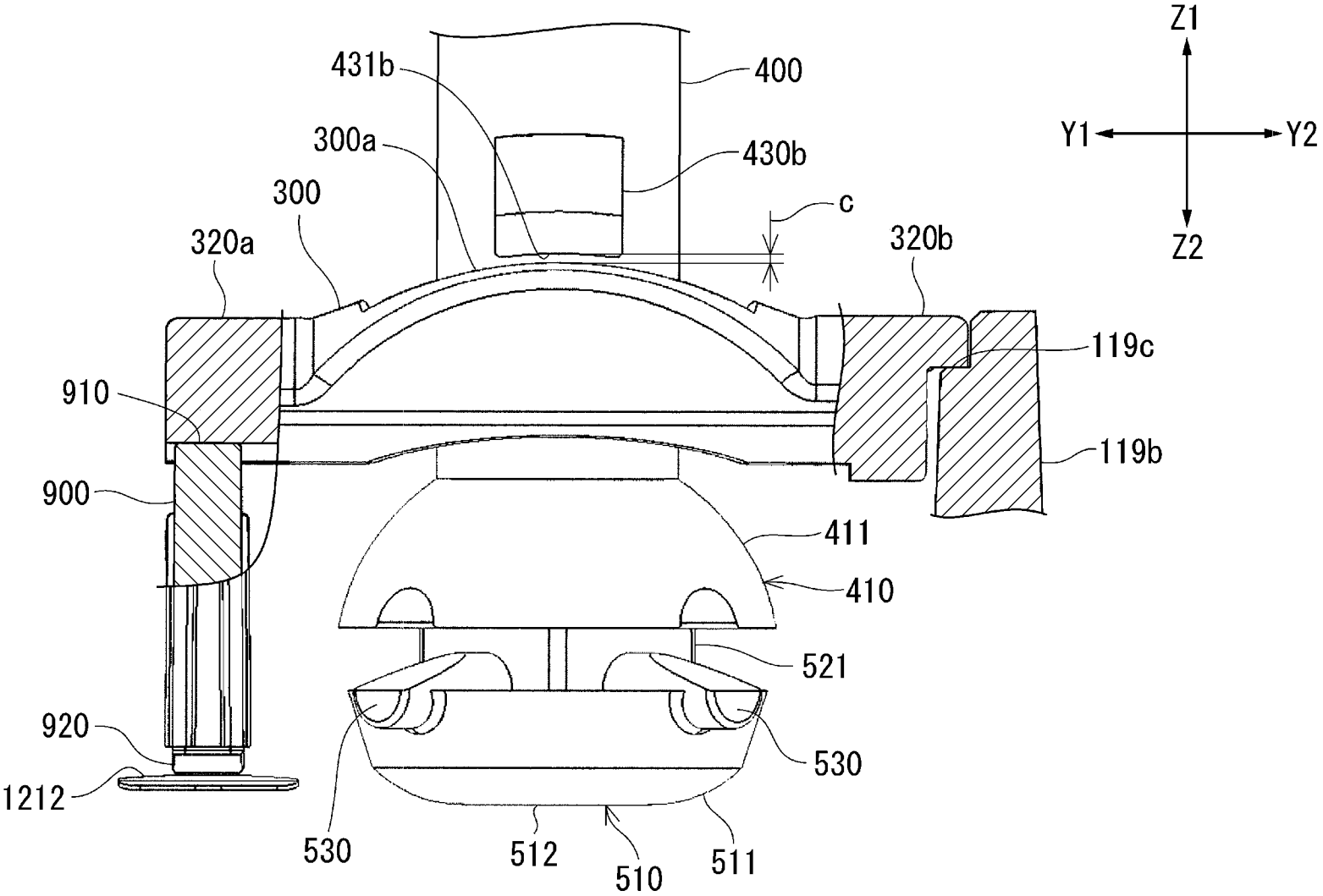
FIG. 14 is a view showing an operation system of a pressing switch.

As shown in FIGS. 9 and 14, the rear slide part 320*b* is fitted slidably in the rear guide groove 102, while the front slide part 320*a* is slidably placed on a front arm hook 910 formed of an upper end surface provided along a cylindrical surface coaxially arranged on the Y axis of the pusher 900 in a state where its front end face slidably abuts on an inner surface of the front guide plate 119*a*, so that the lower arm 300 is bridged in the front-rear direction in a state of being orthogonal to the upper arm 200 right below the upper arm 200 in the case 100, and in that state, the lower arm 300 is supported movably in an arc shape in the lateral direction along the rear guide groove 102. The lower arm 300 moves along a cylindrical surface coaxially arranged on the Y axis.

In the lower arm 300, a front slide part 310*a* on a front end side of the lower arm 300 can be pressed and moved downward with a rear slide part 320*b* on a rear end side of the lower arm 300 as a fulcrum, by a slight gap (clearance) between the rear slide part 320*b* and the rear guide groove 102.

As described above, a pair of the upper and lower arms 200 and 300 are supported movably in two directions orthogonal to each other in the case 100 having the bottom plate 131, and each has the elongated holes 210 and 310 extending in a direction orthogonal to a moving direction.

As shown in FIGS. 1 to 5 and FIGS. 7 to 10, the operation shaft 400 is a round rod-shaped member made of insulating synthetic resin having a diameter that is the same as a width of the elongated holes 210 and 310 of the upper and lower arms 200 and 300. The operation shaft 400 is arranged in the case 100 in a state where, as a middle portion in an axial direction of the operation shaft 400 penetrates the elongated holes 210 and 310 of the upper and lower arms 200 and 300, an upper end portion of the operation shaft 400 protruding above the upper arm 200 is inserted through the opening 121 of the cover 120 and protrudes to the outside of the case 100, and a lower end portion of the operation shaft 400 protruding downward of the lower arm 300 is inserted through an inner diameter of the receiving portion 112 of the body 110 and inserted into the operation shaft accommodation portion 111 of the body 110.

The operation shaft 400 has the spherical trapezoidal portion 410 for rotatably supporting the lower end of the operation shaft 400 while also serving to prevent the operation shaft 400 from coming off, a stepped shaft hole 420 for supporting the actuating member 500 in the lower end of the operation shaft 400 so as to be movable in the axial direction of the operation shaft 400 in a state in which rotation around the axis of the operation shaft 400 is restricted, and also for providing the compression coil spring 600 between the operation shaft 400 and the actuating member 500, a pair of left and right engaging portions 430*a* and 430*b* for pressing and moving the lower arm 300 at the time of pressing and moving the operation shaft 400, an attaching hole 440 for screwing, for example, a disk-like key top, at the upper end of the operation shaft 400, and a two-sided cut portion 450 for locking the key top.

The spherical trapezoidal portion 410 is arranged in the operation shaft accommodation portion 111 of the case 100. The spherical trapezoidal portion 410 is formed in an upward convex spherical trapezoidal shape, in which the diameter decreases upward, in the lower end portion of the operation shaft 400, a radius of an upper surface of the spherical trapezoidal portion 410 is equal to a radius of the operation shaft 400, and the spherical zone 411 of a side surface portion of the spherical trapezoidal portion 410 can be fitted to the receiving surface 112*a* of the receiving portion 112 of the case 100 from below.

The stepped shaft hole 420 is provided coaxially with the operation shaft 400 in an axial center portion of the operation shaft 400, and has a ceiled hole opened on a lower end surface (lower end surface of the operation shaft 400) of the spherical trapezoidal portion 410. The stepped shaft hole 420 has, from bottom to top, a shaft hole 421 having a rectangular cross section, a shaft hole 422 having a rectangular cross section smaller (having a smaller diameter) and longer than the shaft hole 421, a shaft hole 423 having a circular cross section that has the same diameter as the shaft hole 422, the same length as the shaft hole 422, and is capable of accommodating the compression coil spring 600, and a shaft hole 424 having a circular cross section that has a diameter smaller than the shaft hole 423 and is shorter than the shaft hole 423. Downward step surfaces 425, 426, and 427 are provided between the shaft hole 421 and the shaft hole 422, between the shaft hole 422 and the shaft hole 423, and between the shaft hole 423 and the shaft hole 424, respectively.

As shown in FIGS. 1, 9, and 14, the left and right engaging portions 430*a* and 430*b* are protrusions having a right-angled triangular cross-section projecting toward the left and right sides from an outer surface of the middle portion in the axial direction of the operation shaft 400 in the elongated hole 210 of the upper arm 200, and have engaging surfaces 431*a* and 431*b* facing each other with a slight gap (clearance) from above on left and right side edge portions of the elongated hole 310 in the curved upper surface 300*a* of the lower arm 300 in a bottom portion of the left and right engaging portions 430*a* and 430*b*. The engaging surfaces 431*a* and 431*b* are provided along a cylindrical surface coaxially arranged on the X axis, and are engaging surfaces facing downward that are curved along the curved upper surface 300*a* of the lower arm 300, are movable on a curved upper surface of the lower arm 300 when the operation shaft 400 rotates, and move the lower arm 300 along with the pressing movement of the operation shaft 400.

The attaching hole 440 is a bottomed hole provided coaxially with the operation shaft 400 in the axial center portion of the operation shaft 400 and opened on the upper end surface of the operation shaft 400. The two-sided cut portion 450 is provided at the upper end of the operation shaft 400, and the upper end of the operation shaft 400 is formed in a shaft portion having an oblong cross section and a two-surface width.

As shown in FIGS. 1, 6, and FIGS. 8 to 10, the actuating member 500 is made of insulating synthetic resin, and has a spherical trapezoidal portion 510, a stepped shaft portion 520, and a protrusion 530.

Figure 17:
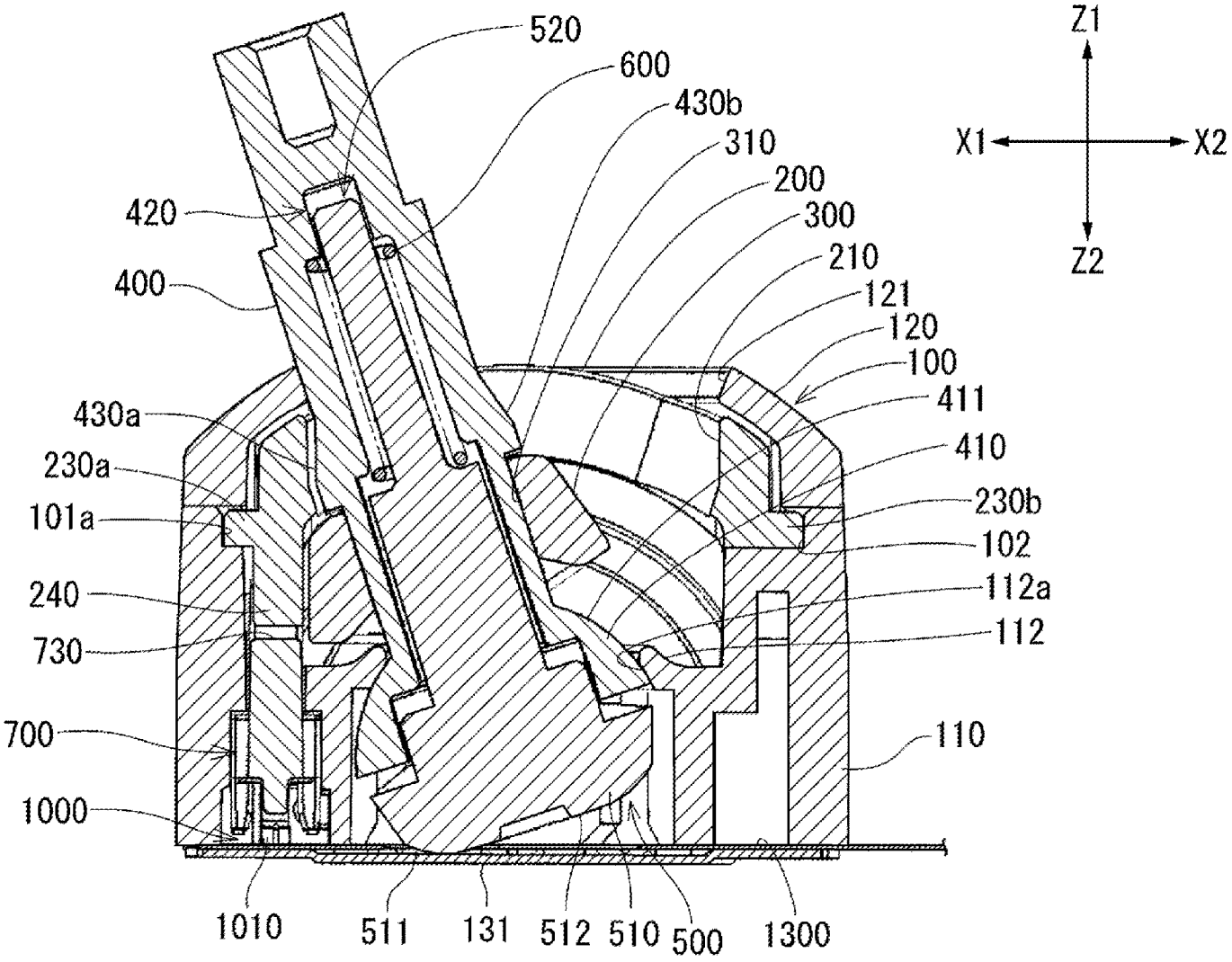
FIG. 17 is a cross-sectional view taken along line A-A of FIG. 16.

The spherical trapezoidal portion 510 is provided at the lower end of the actuating member 500, and is placed in the central portion of the bottom plate 131 exposed in the operation shaft accommodation portion 111 of the case 100. The spherical trapezoidal portion 510 is formed in a downward convex spherical shape whose diameter decreases downward. When the operation shaft 400 is rotated about the center of curvature of the receiving surface 112*a* of the receiving portion 112 of the case 100 from a neutral state shown in FIGS. 8 to 10 in which the shaft direction is perpendicular to the bottom plate 131 of the case 100, that is, tilted in an optional direction around the operation shaft 400 from the neutral state, a spherical zone 511 of a side surface portion of the spherical trapezoidal portion 510 abuts against the bottom plate 131 of the case 100 as shown in FIG. 17, and, when the operation shaft 400 is returned to the neutral state, a flat lower surface 512 of the spherical trapezoidal portion 510 abuts against the bottom plate 131 of the case 100 as shown in FIGS. 8 to 10.

The stepped shaft portion 520 is vertically provided at the center of the upper surface of the spherical trapezoidal portion 510, and is inserted in the shaft hole 420 of the operation shaft 400 so as to be movable in the axial direction of the operation shaft 400. The shaft portion 520 includes, from bottom to top, a square shaft portion 521 having a square cross section fitted in the shaft hole 421, a square shaft portion 522 having a square cross section fitted in the shaft hole 422, and a round shaft portion 523 having a circular cross section that is inserted into the shaft hole 423 together with the compression coil spring 600 in a state of being inserted into an inner diameter of the compression coil spring 600 and has an upper end portion as a spring guide fitted in the shaft hole 424. Upward step surfaces 524 and 525 are provided between the square shaft portion 521 and the square shaft portion 522 and between the square shaft portion 522 and the round shaft portion 523, respectively.

The actuating member 500 is provided with the downward convex spherical trapezoidal portion 510 whose diameter decreases downward at the lower end of the shaft portion 520, and the shaft portion 520 is movably inserted and arranged in the shaft hole 420 of the operation shaft 400 in the axial direction of the operation shaft 400, so that the downward convex spherical trapezoidal portion 510 is movably supported in the axial direction of the operation shaft 400 directly below the upward convex spherical trapezoidal portion 410 provided at the lower end of the operation shaft 400 with the shaft portion 520 interposed between them.

The compression coil spring 600 is made of a metal wire, and, as shown in FIGS. 8 to 10, is inserted into the shaft hole 420 of the operation shaft 400 together with the shaft portion 520 of the actuating member 500 in a state of being fitted to the outer periphery of the round shaft portion 523 of the shaft portion 520 of the actuating member 500 to be accommodated in the shaft hole 423. Upper and lower wound ends are respectively brought into contact with the downward step surface 427 of the shaft hole 420 and the upward step surface 525 of the shaft portion 520, so as to bias the actuating member 500 downward along the axial direction of the operation shaft 400 in such a manner as pressing the spherical zone 511 and the lower surface 512 of the spherical trapezoidal portion 510 of the actuating member 500 against the bottom plate 131 of the case 100 from above, and to bias the operation shaft 400 upward along the axial direction in such a manner as pressing the spherical zone 411 of the spherical trapezoidal portion 410 of the operation shaft 400 from below against the receiving surface 112*a* of the receiving portion 112 of the case 100 from below.

As described above, as shown in FIGS. 8 to 10, the operation shaft 400 is rotatable in a state of penetrating the elongated holes 210 and 310 of the upper and lower arms 200 and 300. By the compression coil spring 600, the spherical trapezoidal portion 510 of the actuating member 500 is pressed against the bottom plate 131 of the case 100 from above, and the spherical zone 411 of the spherical trapezoidal portion 410 of the operation shaft 400 is pressed against the receiving surface 112*a* of the receiving portion 112 of the case 100 from below. In this manner, while being in a state of being prevented from coming off by the receiving portion 112 of the case 100, the operation shaft 400 is supported so as to be rotatable about the center of curvature of the receiving surface 112*a* of the receiving portion 112 of the case 100 together with the actuating member 500, and so as to be able to be pressed and movable in the axial direction.

The first slider 700 is made of insulating synthetic resin. The first slider 700 has, as shown in FIGS. 8 and 11, a first slider main body 710, a first engagement piece 720, a first engagement groove 730, a first engagement protrusion 740, a first movable surface 750, and a first convex portion 760. The first slider main body 710 is a cuboid shaped block. The first engagement piece 720 is provided upright at the center of a flat upper surface of the first slider main body 710. The first engagement groove 730 is provided at the upper end of the first engagement piece 720. The first engagement protrusion 740 is a cylinder that projects downward from the central portion of the flat lower surface of the first slider main body 710.

The first slider 700 is arranged in the first slider accommodation portion 114 so as to be movable in the front-rear direction in a state where the first slider main body 710 is accommodated in the first lower movement path 114*a*, the first engagement piece 720 is inserted through the first upper movement path 114*c*, and the upper end of the first engagement piece 720 projects to the inside of the cover 120. Further, when the engagement protrusion 240 of the upper arm 200 is engaged with the first engagement groove 730 and the upper arm 200 moves in an arc shape in the front-rear direction, the first engagement piece 720 is pressed against the engagement protrusion 240 of the upper arm 200, so that the first slider 700 is movable in the front-rear direction.

The first movable surface 750 is a flat upper surface of the first slider main body 710. The first movable surface 750 faces the first fixing surface 114*b* of the first slider accommodation portion 114, and is slidable in the front-rear direction along the first fixing surface 114*b* in a state of being elastically pressed against the first fixing surface 114*b* by an elastic force of a first contact described later. The first convex portion 760 is fitted to the first concave portion 114*d* provided in the first slider accommodation portion 114 when the first slider 700 is positioned at the neutral position. One of the first convex portion 760 is provided on each of the first movable surface 750 located closer to the front side relative to the first engagement piece 720 and the first movable surface 750 located closer to the rear side relative to the first engagement piece 720. A fitting shape of the first convex portion 760 with the first concave portion 114*d* is a cylindrical surface formed in a cylindrical surface extending in the lateral direction orthogonal to a moving direction (front-rear direction) of the first slider 700, and has an upward convex arc-like cross-sectional shape.

The second slider 800 is made of insulating synthetic resin. The second slider 800 has, as shown in FIGS. 9 and 12, a second slider main body 810, a second engagement piece 820, a second engagement groove 830, a second engagement protrusion 840, a second movable surface 850, and a second convex portion 860. The second slider main body 810 is a cuboid block. The second engagement piece 820 is provided upright at the center of the flat upper surface of the second slider main body 810. The second engagement groove 830 is provided at the upper end of the second engagement piece 820. The second engagement protrusion 840 is a cylinder that projects downward from the central portion of the flat lower surface of the second slider main body 810.

The second slider 800 is arranged in the second slider accommodation portion 115 so as to be movable in the lateral direction in a state where the second slider main body 810 is accommodated in the second lower movement path 115*a*, the second engagement piece 820 is inserted through the second upper movement path 115*c*, and the upper end of the second engagement piece 820 projects to the inside of the cover 120. Further, when the engagement protrusion 330 of the lower arm 300 is engaged with the second engagement groove 830 and the lower arm 300 moves in an arc shape in the lateral direction, the second engagement piece 820 is pressed against the engagement protrusion 330 of the lower arm 300, so that the second slider 800 is movable in the lateral direction.

The second movable surface 850 is a flat upper surface of the second slider main body 810. The second movable surface 850 faces the second fixing surface 115*b* of the second slider accommodation portion 115, and is slidable in the lateral direction along the second fixing surface 115*b* in a state of being elastically pressed against the second fixing surface 115*b* by an elastic force of a second contact described later. The second convex portion 860 is fitted to the second concave portion 115*d* provided in the second slider accommodation portion 115 when the second slider 800 is positioned at the neutral position, and is provided on each of the second movable surface 850 located closer to the front side relative to the second engagement piece 820 and the second movable surface 850 located closer to the rear side relative to the second engagement piece 820. A fitting shape of the second convex portion 860 with the second concave portion 115*d* is a cylindrical surface formed in a cylindrical surface extending in the front-rear direction orthogonal to a moving direction (front-rear direction) of the second slider 800, and has an upward convex arc-like cross-sectional shape.

Figure 6:
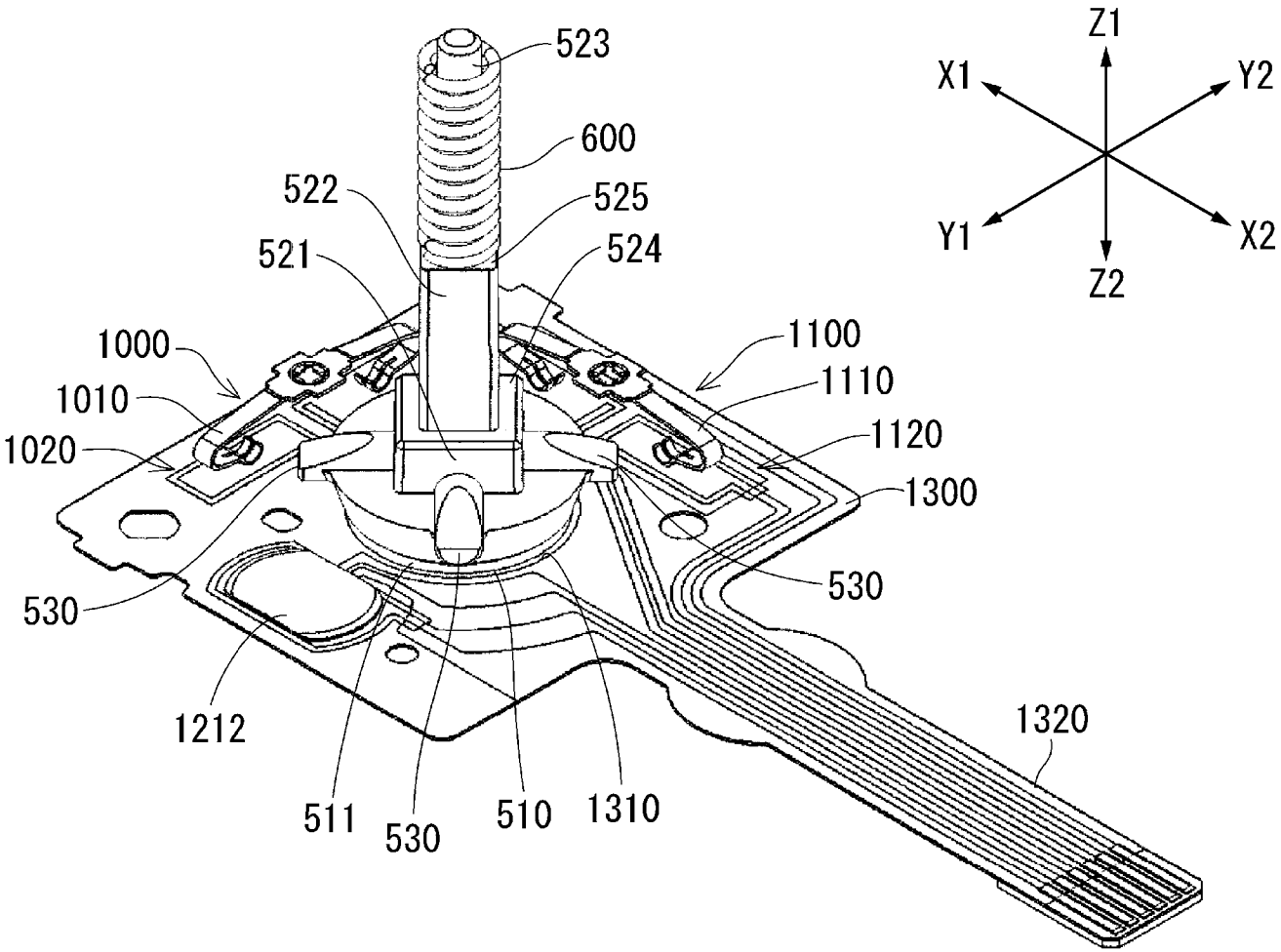
FIG. 6 is a perspective view of a state in which an operation shaft, first and second sliders, and a pusher in FIG. 5 are transparent.
Figure 7:
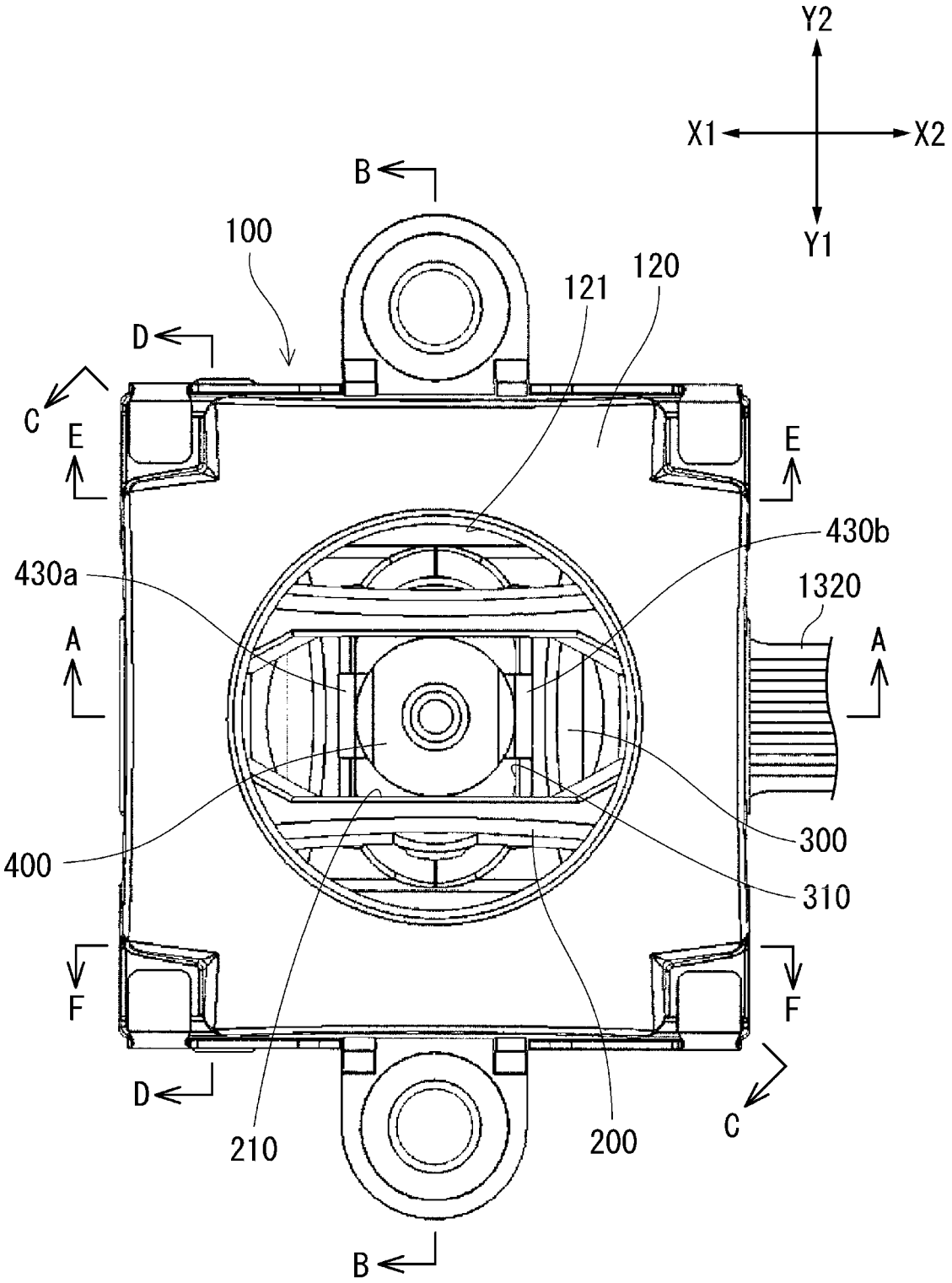
FIG. 7 is a plan (top) view of the multi-directional input device according to the embodiment of the present invention.

The first variable resistor 1000 can detect a moving direction and a movement amount of the upper arm 200 by detecting a moving direction and a movement amount of the first slider 700 as a change in a resistance value. The first variable resistor 1000 has a first contact 1010 and a first resistance circuit 1020 as shown in FIGS. 1, 6, and 11. The first resistance circuit 1020 is formed on the substrate 1300. The first contact 1010 is a metal plate spring piece. The first contact 1010 is fixed to the lower surface of the first slider main body 710 with the first engagement protrusion 740 interposed between them. The first contact 1010 is in contact with the first resistance circuit 1020 and makes the first resistance circuit 1020 conductive. The first contact 1010 is slidable on the first resistance circuit 1020 according to the movement of the first slider 700 in the front-rear direction. As the first contact 1010 slides on the first resistance circuit 1020 in this manner, a resistance value of the first variable resistor 1000 changes.

The second variable resistor 1100 can detect a moving direction and a movement amount of the lower arm 300 by detecting a moving direction and a movement amount of the second slider 800 as a change in a resistance value. The second variable resistor 1100 has a second contact 1110 and a second resistance circuit 1120 as shown in FIGS. 1, 6, and 12. The second resistance circuit 1120 is formed on the substrate 1300. The second contact 1110 is a metal plate spring piece. The second contact 1110 is fixed to the lower surface of the second slider main body 810 with the second engagement protrusion 840 interposed between them. The second contact 1110 is in contact with the second resistance circuit 1120 and makes the second resistance circuit 1120 conductive. The second contact 1110 is slidable on the second resistance circuit 1120 according to the movement of the second slider 800 in the lateral direction. As the second contact 1110 slides on the second resistance circuit 1120 in this manner, a resistance value of the second variable resistor 1100 changes.

The pressing switch 1200 detects a pressing movement of the operation shaft 400. The pressing switch 1200 has a metal dome sheet 1210 and a switch circuit 1220 as shown in FIGS. 1, 5, 6, 9, and 13. The metal dome sheet 1210 has a cover sheet 1211 and a metal dome 1212. The cover sheet 1211 is a single-sided adhesive sheet. The metal dome 1212 is a movable contact made of an upward convex dome-shaped metal plate, and, as shown in FIG. 14, biases the pusher 900 upward. The upper surface of the metal dome 1212 is adhered to the lower surface of the cover sheet 1211 to form the metal dome sheet 1210. The switch circuit 1220 has a central fixed contact 1221 and an outer fixed contact 1222. The central fixed contact 1221 has a circular shape and is formed on the upper surface of the substrate 1300 which is the lower surface of the pressing switch accommodation portion 116. The central fixed contact 1221 is arranged immediately below the pusher accommodation portion 117. The outer fixed contact 1222 is formed in the shape of a horseshoe to surround the central fixed contact 1221 with space and is formed on the upper surface of the substrate 1300.

In the pressing switch 1200, the metal dome sheet 1210 is adhered to the upper surface of the substrate 1300, which is the lower surface of the pressing switch accommodation portion 116, the metal dome 1212 is fixed on the outer fixed contact 1222 across the central fixed contact 1221, both ends in the lateral direction of the metal dome 1212 are in contact with the outer fixed contact 1222, and the top of the metal dome 1212 is separated from and faces the central fixed contact 1221 immediately below with a gap between them.

The pusher 900 is a drive member for transmitting a pressing movement of the operation shaft 400 to the top of the metal dome 1212 together with the lower arm 300. As shown in FIGS. 1, 5, 9, 13, and 14, the pusher 900 is formed of insulating synthetic resin in a rectangular plate shape, and has a front arm hook 910 on which the front slide part 320*a* of the lower arm 300 is placed slidably and a pressing portion 920 for pressing the pressing switch 1200. The pusher 900 is vertically movably supported in the case 100. The pusher 900 is vertically movably fitted and held in the pusher accommodation portion 117, and while the upper end of the pusher 900 projects to the inner surface side of the front guide plate 119*a* to face the rear guide plate 119*b*, the lower end surface of the pusher 900 is exposed to the inside of the pressing switch accommodation portion 116 to face the metal dome sheet 1210. The front arm hook 910 is provided along a cylindrical surface coaxially arranged on the Y-axis, and is formed of an upper end surface of the upward convex arc-shaped curved pusher 900. The pressing portion 920 is a conical boss provided at the center of the lower end surface of the pusher 900 and having a diameter decreasing downward, and the lower end surface abuts on the top of the metal dome sheet 1210 corresponding to the top of the metal dome 1212. The pusher 900 is interposed between the front slide part 320*a* of the lower arm 300 and the pressing switch 1200.

Next, the operation of the multi-directional input device according to the embodiment of the present invention will be described.

First, when no operating force is applied to the upper end of the operation shaft 400, as shown in FIGS. 8 and 9, the flat lower surface 512 of the downward convex spherical trapezoidal portion 510 of the actuating member 500 is pressed against the bottom plate 131 of the case 100 by a biasing force (elastic force) of the compression coil spring 600 so as to be in a horizontal state with respect to the bottom plate 131, and the operation shaft 400 is held in a neutral state where the axial direction of the operation shaft 400 is perpendicular to the bottom plate 131 of the case 100.

Figure 16:
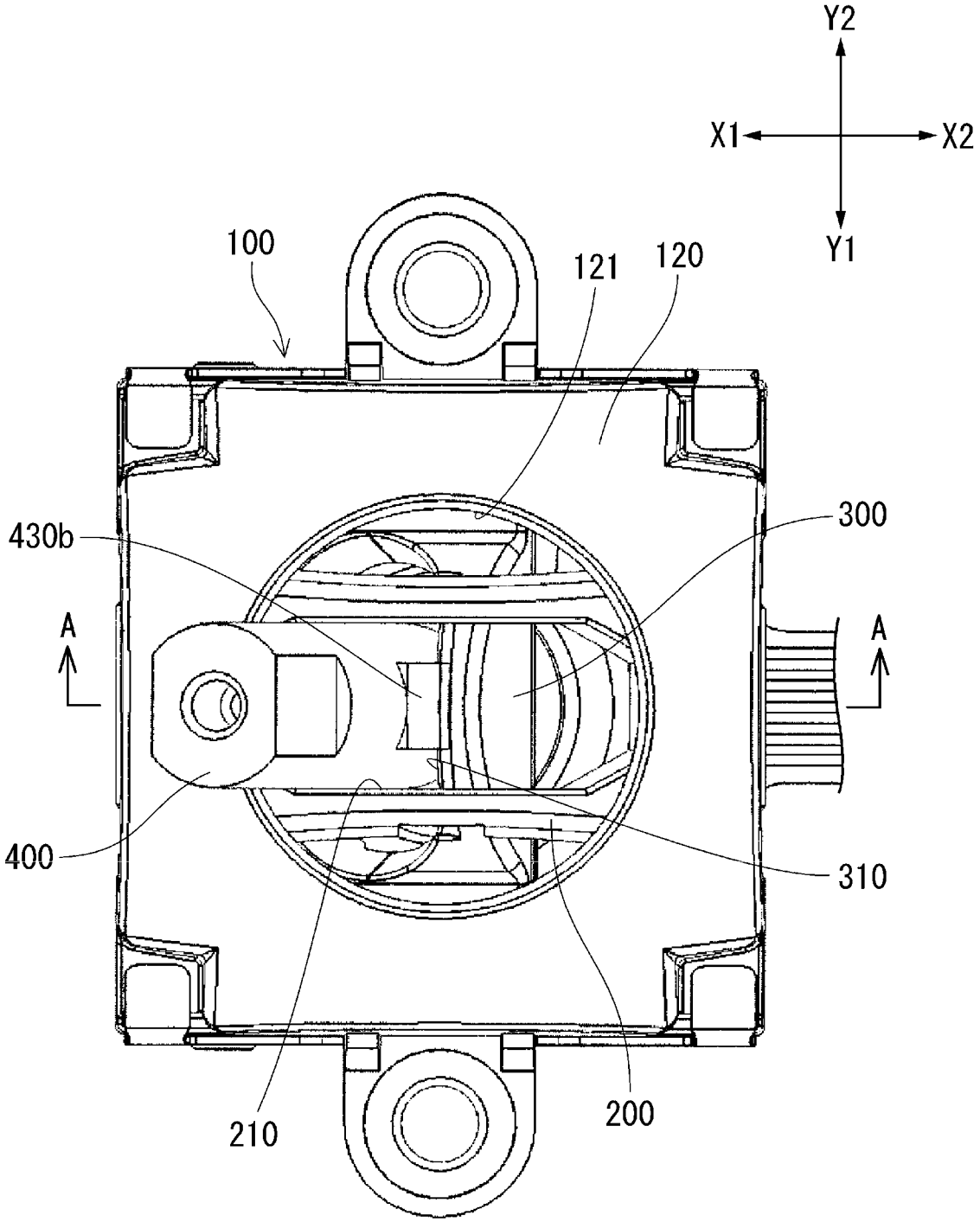
FIG. 16 is a plan (top) view for explaining operation of the multi-directional input device according to the embodiment of the present invention.

When the upper end of the operation shaft 400 in the neutral state is pressed in the left direction along the elongated hole 210 of the upper arm 200, the operation shaft 400 rotates around the center of curvature of the receiving surface 112*a* of the receiving portion 112 of the case 100 together with the actuating member 500 and tilts left along the elongated hole 210 of the upper arm 200 in a state where the operation shaft 400 is prevented from coming off by the receiving portion 112 of the case 100 as shown in FIGS. 16 and 17.

Then, an arched portion of the lower arm 300 is pressed in the left direction orthogonal to the longitudinal direction of the elongated hole 310 by the operation shaft 400, and the lower arm 300 is guided by the rear guide groove 102 of the case 100 to move leftward in an arc shape. At this time, since the operation shaft 400 moves leftward in the elongated hole 210 of the upper arm 200, the upper arm 200 and the first slider 700 are held at their neutral positions (initial positions).

On the other hand, with the movement of the lower arm 300, the second engagement piece 820 of the second slider 800 is pressed against the engagement protrusion 330 of the lower arm 300, and the second slider 800 is guided to the second slider accommodation portion 115 to move in the inside of the second slider accommodation portion 115 to the left.

At this time, the second convex portion 860 provided on the second slider 800 comes off the second concave portion 115*d* provided on the second slider accommodation portion 115 of the case 100 against the elastic force of the second contact 1110 of the second variable resistor 1100, and moves under the flat second fixing surface 115*b* located on the left side of the second concave portion 115*d*.

Then, when the second contact 1110 of the second variable resistor 1100 slides on the second resistance circuit 1120 as the second slider 800 moves, a resistance value of the second variable resistor 1100 changes. In this manner, the second variable resistor 1100 detects a moving direction and a movement amount of the second slider 800 as a moving direction and a movement amount of the lower arm 300. These are input from the tail portion 1320 of the substrate 1300 to a control unit of an electronic device via a connector and detected as a rotating direction and a rotation amount of the operation shaft 400 by the control unit.

When the pressing of the operation shaft 400 is released, the operation shaft 400 returns to the neutral state together with the actuating member 500 while the flat lower surface 512 of the downward convex spherical trapezoidal portion 510 of the actuating member 500 is returned to the horizontal state by the biasing force of the compression coil spring 600.

When the operation shaft 400 returns to the neutral state, the lower arm 300 returns to the neutral position, and when the lower arm 300 returns to the neutral position, the second slider 800 returns to the neutral position.

At this time, the second slider 800 is moved so as to be guided to the neutral position immediately before its movement to the neutral position while the second concave portion 115*d* and the second convex portion 860 are fitted by the elastic force of the second contact 1110 of the second variable resistor 1100, and the second slider 800 is accurately returned to its neutral position without error while parts manufacturing tolerance and the like are absorbed.

Further, when the upper end of the operation shaft 400 in the neutral state is pressed in the front direction along the elongated hole 310 of the lower arm 300, the operation shaft 400 rotates around the center of curvature of the receiving surface 112*a* of the receiving portion 112 of the case 100 together with the actuating member 500 and tilts front along the elongated hole 310 of the lower arm 300 in a state where the operation shaft 400 is prevented from coming off by the receiving portion 112 of the case 100.

Then, the arched portion of the upper arm 200 is pressed forward by the operation shaft 400, and the upper arm 200 is guided by the left and right guide grooves 101*a* and 101*b* of the case 100 to move in an arc shape in the front direction. At this time, since the operation shaft 400 moves in the front direction in the elongated hole 310 of the lower arm 300, the lower arm 300 and the second slider 800 are held at their neutral positions (initial positions).

On the other hand, with the movement of the upper arm 200, the first engagement piece 720 of the first slider 700 is pressed against the engagement protrusion 240 of the upper arm 200, and the first slider 700 is guided to the first slider accommodation portion 114 to move in the inside of the first slider accommodation portion 114 in the front direction.

At this time, the first convex portion 760 provided on the first slider 700 comes off the first concave portion 114*d* provided on the first slider accommodation portion 114 of the case 100 against the elastic force of the first contact 1010 of the first variable resistor 1000, and moves under the flat first fixing surface 114*b* located on the front side of the first concave portion 114*d*.

Then, when the first contact 1010 of the first variable resistor 1000 slides on the first resistance circuit 1020 as the first slider 700 moves, a resistance value of the first variable resistor 1000 changes. In this manner, the first variable resistor 1000 detects a moving direction and a movement amount of the first slider 700 as a moving direction and a movement amount of the upper arm 200. These are input from the tail portion 1320 of the substrate 1300 to a control unit of an electronic device via a connector and detected as a rotating direction and a rotation amount of the operation shaft 400 by the control unit.

When the pressing of the operation shaft 400 is released, the operation shaft 400 returns to the neutral state together with the actuating member 500 while the flat lower surface 512 of the downward convex spherical trapezoidal portion 510 of the actuating member 500 is returned to the horizontal state by the biasing force of the compression coil spring 600.

When the operation shaft 400 returns to the neutral state, the upper arm 200 returns to the neutral position, and when the upper arm 200 returns to the neutral position, the first slider 700 returns to the neutral position.

At this time, the first slider 700 is moved so as to be guided to the neutral position immediately before its movement to the neutral position while the first concave portion 114*d* and the first convex portion 760 are fitted by the elastic force of the first contact 1010 of the first variable resistor 1000, and the first slider 700 is accurately returned to its neutral position without error while parts manufacturing tolerance and the like are absorbed.

Furthermore, in a state of being prevented from coming off by the receiving portion 112 of the case 100, the operation shaft 400 can rotate (tilt) around the center of curvature of the receiving surface 112*a* of the receiving portion 112 of the case 100 together with the actuating member 500 in all directions 360° around the operation shaft 400, and, in a tilting state, the operation shaft 400 can rotate by changing a tilt position in a direction along the opening 121 of the cover 120.

At this time, an end of each of the protrusions 530 of the actuating member 500 moves in the vertical direction in the guide groove 113 of the case 100, and the spherical zone 511 of the downward convex spherical trapezoidal portion 510 of the actuating member 500 comes into rolling contact with the bottom plate 131 of the case 100 without slipping.

Further, when the upper end of the operation shaft 400 is pressed downward, the operation shaft 400 is pressed down to separate the spherical zone 411 of the spherical trapezoidal portion 410 of the operation shaft 400 from the receiving surface 112*a* of the receiving portion 112 of the case 100 while pressing the shaft portion 520 of the actuating member 500 into the shaft hole 420 of the operation shaft 400 against the compression coil spring 600. The left and right sided edge portions of the elongated hole 310 on the curved upper surface 300*a* of the lower arm 300 are pressed downward by the left and right engaging surfaces 431*a* and 431*b* of the left and right engaging portions 430*a* and 430*b* of the operation shaft 400.

In this manner, the front slide part 310*a* on the front end side of the lower arm 300 slidably mounted on the upper end surface (front arm hook 910) of the pusher 900 is pressed and moved with the rear slide part 320*b* on the rear end side of the lower arm 300 slidably fitted in the rear guide groove 102 of the case 100 as a fulcrum. Along with the above, the pusher 900 moves downward.

Then, with the downward movement of the pusher 900, the top of the metal dome 1212 of the pressing switch 1200 is pressed down by the pressing portion 920 of the pusher 900, the top of the metal dome 1212 is elastically deformed in a downward convex shape with a click feeling and comes into contact with the central fixed contact 1221 of the switch circuit 1220 of the pressing switch 1200, and a switch-on state in which the central fixed contact 1221 and the outer fixed contact 1222 are electrically connected via the metal dome 1212 is established, so that the pressing movement of the operation shaft 400 is detected.

At this time, the lower arm 300 functions as a "lever", and a fulcrum (the rear slide part 320*b* of the lower arm 300) is placed in a location that is on an outer side of a force application point (the left and right engaging portions 430*a* and 430*b* of the operation shaft 400) and an action point (the front slide part 310*a* of the lower arm 300) and close to the force application point, so that a small movement applied to the force application point becomes a large movement at the action point and a smaller force than the applied force is transmitted. In this manner, a pressing movement amount of the operation shaft 400 for operating the pressing switch 1200 can be reduced, and an excellent click feeling can be obtained.

When the pressing of the operation shaft 400 is released, the operation shaft 400 is pressed up and moved so as to press the spherical zone 411 of the spherical trapezoidal portion 410 of the operation shaft 400 against the receiving surface 112*a* of the receiving portion 112 of the case 100 while the shaft portion 520 of the actuating member 500 is pulled out from the shaft hole 420 of the operation shaft 400 by the biasing force of the compression coil spring 600, and returns to the state before the pressing movement.

On the other hand, the top of the metal dome 1212 returns to the original upward convex shape. Along with the above, the top of the metal dome 1212 is separated from the central fixed contact 1221 of the switch circuit 1220, and a switch-off state in which the central fixed contact 1221 and the outer fixed contact 1222 are electrically disconnected is established. The biasing force of the metal dome 1212 causes the pusher 900 to move upward and return to the original position, and the lower arm 300 returns to the original horizontal state accordingly.

As described above, the multi-directional input device according to an embodiment of the present invention includes the case 100 having the bottom plate 131, a pair of the upper and lower arms 200 and 300 supported to be movable in two orthogonal directions in the inside of the case 100, the arms having the elongated holes 210 and 310 extending in a direction orthogonal to a moving direction, the operation shaft 400 that is rotatable in a state of penetrating the elongated holes 210 and 310, the actuating member 500 that is supported so as to be movable in an axial direction of the operation shaft 400 at a lower end of the operation shaft 400 projecting downward of the lower arm 300, and is provided with the downward convex spherical trapezoidal portion 510 whose diameter decreases downward, the compression coil spring 600 that is provided between the operation shaft 400 and the actuating member 500, and presses the downward convex spherical trapezoidal portion 510 against the bottom plate 131 to return the operation shaft 400 to a neutral state, and a plurality of the electric components 1000 and 1100 operated via the arms 200 and 300 by rotation of the operation shaft 400. An upward convex spherical trapezoidal portion 410 whose diameter decreases upward is provided at a lower end of the operation shaft 400 projecting downward of the lower arm 300. The receiving portion 112 for the upward convex spherical trapezoidal portion 410 is provided in the case 100. The receiving portion 112 has the receiving surface 112*a* that is configured with a spherical surface having the same radius of curvature as radius of curvature of the spherical zone 411 of the upward convex spherical trapezoidal portion 410, the receiving surface 112*a* against which the spherical zone 411 of the upward convex spherical trapezoidal portion 410 is pressed from downward by the compression coil spring 600. The operation shaft 400 is supported to be rotatable about the center of curvature of the receiving surface 112*a*. In this manner, since the operation shaft 400 is supported so as to be rotatable about the curvature center of the receiving surface 112*a* of the receiving portion 112 while being prevented from coming off by the receiving portion 112 positioned downward of the lower arm 300, the entire height of the device is reduced even if the rotation radius of the operation shaft 400 is increased, and the device can be downsized without lowering the strength of the operation shaft 400 and the lower arm 300.

Further, the case 100 having the bottom plate 131, a pair of the upper and lower arms 200 and 300 supported so as to be movable in two orthogonal directions in the inside of the case 100, the arms having the elongated holes 210 and 310 extending in a direction orthogonal to a moving direction, the operation shaft 400 that is rotatable in a state of penetrating the elongated holes 210 and 310, the actuating member 500 that is supported so as to be movable in an axial direction of the operation shaft 400 at a lower end of the operation shaft 400 projecting downward of the lower arm 300, and is provided with the downward convex spherical trapezoidal portion 510 whose diameter decreases downward, the compression coil spring 600 that is provided between the operation shaft 400 and the actuating member 500, and presses the downward convex spherical trapezoidal portion 510 against the bottom plate 131 to return the operation shaft 400 to a neutral state, and a plurality of the electric components 1000 and 1100 operated via the arms 200 and 300 by rotation of the operation shaft 400 are included. The actuating member 500 is supported at a lower end of the operation shaft 400 in a state of reducing rotation around an axis of the operation shaft 400 and is provided with the protrusion 530 projecting radially outward from an upper end of the downward convex spherical trapezoidal portion 510. The protrusion 530 is inserted to be movable vertically in the guide groove 113 that extends in the vertical direction on an inner wall of the case 100, so that rotation around an axis of the operation shaft 400 of the actuating member 500 is reduced. In this manner, rotation around an axis of the operation shaft 400 is reduced via the actuating member 500. Therefore, degree of freedom in a shape of the lower arm 300 is increased, the lower arm 300 can be downsized, and the device can be downsized.

Further, the case 100 having the bottom plate 131, a pair of the upper and lower arms 200 and 300 supported so as to be movable in two orthogonal directions in the inside of the case 100, the arms having the elongated holes 210 and 310 extending in a direction orthogonal to a moving direction, the operation shaft 400 that is rotatable in a state of penetrating the elongated holes 210 and 310, the actuating member 500 that is supported so as to be movable in an axial direction of the operation shaft 400 at a lower end of the operation shaft 400 projecting downward of the lower arm 300, and is provided with the downward convex spherical trapezoidal portion 510 whose diameter decreases downward, the compression coil spring 600 that is provided between the operation shaft 400 and the actuating member 500, and presses the downward convex spherical trapezoidal portion 510 against the bottom plate 131 to return the operation shaft 400 to a neutral state, and a plurality of the electric components 1000 and 1100 operated via the arms 200 and 300 by rotation of the operation shaft 400 are included. The upward convex spherical trapezoidal portion 410 whose diameter decreases upward is provided at a lower end of the operation shaft 400 projecting downward of the lower arm 300. The receiving portion 112 for the upward convex spherical trapezoidal portion 410 is provided in the case 100. The receiving portion 112 has the receiving surface 112*a* that is configured with a spherical surface having the same radius of curvature as radius of curvature of the spherical zone 411 of the upward convex spherical trapezoidal portion 410, the receiving surface against which the spherical zone 411 of the upward convex spherical trapezoidal portion 410 is pressed from downward by the compression coil spring 600. The operation shaft 400 is supported so as to be rotatable about the center of curvature of the receiving surface 112*a*. The lower arm 300 has the curved upper surface 300*a* provided along a cylindrical surface arranged coaxially on one horizontal axis (X axis) that passes through the center of curvature of the receiving surface 112*a* and extends in a moving direction of the lower arm 300. The operation shaft 400 is provided with the engaging portions 430*a* and 430*b* with the lower arm 300. The engaging portions 430*a* and 430*b* have the downward engaging surfaces 431*a* and 431*b* that are curved along the curved upper surface 300*a* of the lower arm 300 and are movable on the curved upper surface 300*a* of the lower arm 300 when the operation shaft 400 rotates. In this manner, the operation shaft 400 in a state of being inserted through the elongated hole 310 of the lower arm 300 from downward is rotated by 90° so that the downward engaging surfaces 431*a* and 431*b* of the engaging portions 430*a* and 430*b* of the operation shaft 400 are arranged to face the curved upper surface 300*a* of the lower arm 300 for assembly. Accordingly, the operation shaft 400 and the lower arm 300 can be provided with enough strength, and the device can be downsized without lowering of the strength of the operation shaft 400 and the lower arm 300.

Note that, in a case where the pressing switch 1200 is not included, the lower arm 300 does not have to be moved downward, and the pusher 900 does not have to be included. Therefore, in the lower arm 300, while the rear slide part 320*b* is slidably fitted into the rear guide groove 102, the front slide part 320*a* is slidably fitted to a front guide groove that is formed between an end surface of the front guide plate 119*a* provided with a front arm hook, which is provided in the front guide plate 119*a* in place of the front arm hook 910 formed of the upper end surface of the pusher 900, and an end surface of the front guide hole 122*a* of the cover 120. In this manner, the lower arm 300 is bridged in the front-rear direction at a right angle to the upper arm 200 directly below the upper arm 200 in the case 100, and, in this state, is supported to be movable in an arc shape in the lateral direction along the front and rear guide grooves 102, and can move along a cylindrical surface coaxially arranged on the Y axis. Then, in a case where the pressing switch 1200 is not included, the engaging portions (the engaging portions 430*a* and 430*b* and the curved upper surface 300*a*) of the operation shaft 400 and the lower arm 300 prevent the operation shaft 400 from moving downward needlessly.

Further, the pusher 900 supported movably in the vertical direction and the pressing switch 1200 for detecting the pressing movement of the operation shaft 400 are further included in the case 100, the lower arm 300 moving downward with the pressing movement of the operation shaft 400 moves downward the pusher 900, and the pressing switch 1200 is operated via the pusher 900. In this manner, before the pusher 900 is incorporated, the lower arm 300 has degree of freedom in a downward direction, and there is no possibility of interference between the downward engaging surfaces 431*a* and 431*b* of the engaging portions 430*a* and 430*b* of the operation shaft 400 and the curved upper surface 300*a* of the lower arm 300 even if the operation shaft is rotated by 90° and assembled. For this reason, a gap (clearance) between them is sufficiently reduced, and the pressing switch 1200 can be operated with a short stroke.

In the description of the multi-directional input device according to one embodiment of the present invention, a fitting shape between the shaft hole 420 of the operation shaft 400 and the shaft portion 520 of the actuating member 500 is a polygon as a section for locking the axial movement of the operation shaft 400 between the operation shaft 400 and the actuating member 500. However, spline fitting may be employed.

What is claimed is:

1. A multi-directional input device, comprising:

a case having a bottom plate;

a pair of upper and lower arms supported to be movable in two orthogonal directions in the case, the pair of upper and lower arms each having an elongated hole extending in a direction orthogonal to a moving direction;

an operation shaft that is rotatable in a state of penetrating each elongated hole;

an actuating member that is supported to be movable in an axial direction of the operation shaft at a lower end of the operation shaft projecting downward of the lower arm, and is provided with a downward convex spherical trapezoidal portion whose diameter decreases downward;

a compression coil spring that is provided between the operation shaft and the actuating member, and presses the downward convex spherical trapezoidal portion against the bottom plate to return the operation shaft to a neutral state; and a plurality of electric components operated via each arm by rotation of the operation shaft, wherein an upward convex spherical trapezoidal portion whose diameter decreases upward is provided at a lower end of the operation shaft projecting downward of the lower arm, a receiving portion for the upward convex spherical trapezoidal portion is provided in the case, the receiving portion has a receiving surface that is configured with a spherical surface having a radius of curvature identical to a radius of curvature of a spherical zone of the upward convex spherical trapezoidal portion, the receiving surface against which a spherical zone of the upward convex spherical trapezoidal portion is pressed from downward by the compression coil spring, and the operation shaft is supported to be rotatable about a center of curvature of the receiving surface.

2. A multi-directional input device, comprising:

a case having a bottom plate;

a pair of upper and lower arms supported to be movable in two orthogonal directions in the case, the pair of upper and lower arms each having an elongated hole extending in a direction orthogonal to a moving direction;

an operation shaft that is rotatable in a state of penetrating each elongated hole;

an actuating member that is supported to be movable in an axial direction of the operation shaft at a lower end of the operation shaft projecting downward of the lower arm, and is provided with a downward convex spherical trapezoidal portion whose diameter decreases downward;

a compression coil spring that is provided between the operation shaft and the actuating member, and presses the downward convex spherical trapezoidal portion against the bottom plate to return the operation shaft to a neutral state; and a plurality of electric components operated via each arm by rotation of the operation shaft, wherein the actuating member is supported at a lower end of the operation shaft projecting downward of the lower arm in a state of reducing rotation around an axis of the operation shaft, and is provided with a protrusion projecting radially outward from an upper end of the downward convex spherical trapezoidal portion, and the protrusion is inserted to be movable vertically in a guide groove that extends in a vertical direction on an inner wall of the case, so that rotation around an axis of the operation shaft of the actuating member is reduced.

3. A multi-directional input device, comprising:

a case having a bottom plate;

a pair of upper and lower arms supported to be movable in two orthogonal directions in the case, the pair of upper and lower arms each having an elongated hole extending in a direction orthogonal to a moving direction;

an operation shaft that is rotatable in a state of penetrating each elongated hole;

an actuating member that is supported to be movable in an axial direction of the operation shaft at a lower end of the operation shaft projecting downward of the lower arm, and is provided with a downward convex spherical trapezoidal portion whose diameter decreases downward;

a compression coil spring that is provided between the operation shaft and the actuating member, and presses the downward convex spherical trapezoidal portion against the bottom plate to return the operation shaft to a neutral state; and a plurality of electric components operated via each arm by rotation of the operation shaft, wherein an upward convex spherical trapezoidal portion whose diameter decreases upward is provided at a lower end of the operation shaft projecting downward of the lower arm, a receiving portion for the upward convex spherical trapezoidal portion is provided in the case, the receiving portion has a receiving surface that is configured with a spherical surface having a radius of curvature identical to a radius of curvature of a spherical zone of the upward convex spherical trapezoidal portion, the receiving surface against which a spherical zone of the upward convex spherical trapezoidal portion is pressed from downward by the compression coil spring, the operation shaft is supported to be rotatable about a center of curvature of the receiving surface, the lower arm has a curved upper surface provided along a cylindrical surface arranged coaxially on one horizontal axis that passes through the center of curvature of the receiving surface and extends in a moving direction of the lower arm, the operation shaft is provided with an engaging portion with the lower arm, and the engaging portion has a downward engaging surface that is curved along the curved upper surface of the lower arm and is movable on the curved upper surface of the lower arm when the operation shaft rotates.

4. The multi-directional input device according to claim 3, further comprising:

a pusher that is supported to be vertically movable in the case; and a pressing switch that detects pressing movement of the operation shaft, wherein the pusher is moved by the lower arm that is moved downward with pressing movement of the operation shaft, and the pressing switch is operated via the pusher.

* * * * *